US012714171B2

(12) United States Patent
Adams

(10) Patent No.: US 12,714,171 B2
(45) Date of Patent: Aug. 25, 2026

(54) HAIR EXTENSION BAR COMB TOOL AND METHOD OF USE

(71) Applicant: Crystal Adams, Boca Raton, FL (US)

(72) Inventor: Crystal Adams, Boca Raton, FL (US)

( * ) Notice: Subject to any disclaimer, the term of this patent is extended or adjusted under 35 U.S.C. 154(b) by 538 days.

(21) Appl. No.: 18/070,411

(22) Filed: Nov. 28, 2022

(65) Prior Publication Data

US 2024/0122283 A1 Apr. 18, 2024

Related U.S. Application Data

(63) Continuation-in-part of application No. 16/411,895, filed on May 14, 2019, now Pat. No. 11,510,448.

(60) Provisional application No. 62/702,565, filed on Jul. 24, 2018.

(51) Int. Cl.
*A41G 5/00* (2006.01)

(52) U.S. Cl.
CPC ..... *A41G 5/004* (2013.01)

(58) Field of Classification Search
CPC ..... A45D 44/00; A45D 44/02; A45D 44/04; A45D 44/14; A45D 2002/003; A45D 24/02; A45D 24/10; A45D 24/38; A45D 19/005; A45D 19/0066; A45D 19/012; A45D 19/016; A45D 19/026; A45D 20/14; A41G 5/00; A41G 5/004; A41G 5/0086; A41G 5/0046
USPC ..... D28/10, 73, 93
See application file for complete search history.

(56) References Cited

U.S. PATENT DOCUMENTS

| | | | |
|---|---|---|---|
| 1,401,576 | A | 12/1921 | Babirad |
| 2,678,047 | A | 5/1954 | Garfield |
| D450,339 | S | 11/2001 | Eason |

(Continued)

FOREIGN PATENT DOCUMENTS

| | | |
|---|---|---|
| FR | 3005556 | 11/2014 |
| WO | WO 2004057995 | 7/2004 |
| WO | WO 2015121606 | 8/2015 |

OTHER PUBLICATIONS

Unboxing: Hair Extension Organizer Stand—DoctoredLocks.com (Year: 2016).*

(Continued)

*Primary Examiner* — Rachel R Steitz
*Assistant Examiner* — Karim Asqiriba
(74) *Attorney, Agent, or Firm* — Allen D Hertz, P.A.; Allen D. Hertz

(57) ABSTRACT

A hair extension bar assembly retains hair extensions for a coloration or treatment process on an elongated platform. First and second comb teeth rows are mounted in parallel on laterally spaced apart side regions of the base, typically on a top flat surface. The use, a portion of the comb teeth captures extension hair. A coloration/treatment process is engaged on captured extension hair in the lateral space between the first comb teeth row and the second comb teeth row. A hair extension retention system can utilize pins pushed into a pin receiving member and/or a magnetic attraction between a magnetically charged element and a magnetically attracting element. The hair extension bar assembly can be supported by a floor, table, clamp or other support system. Hair styling tools can be supported by an accessory retention member, such as a magnetic bar carried by the elongated platform.

18 Claims, 19 Drawing Sheets

(56) References Cited

U.S. PATENT DOCUMENTS

| | | | | |
|---|---|---|---|---|
| 8,998,002 | B1 * | 4/2015 | Milner | A47F 7/00 211/13.1 |
| 9,750,327 | B2 | 9/2017 | Smiley | |
| 10,149,529 | B1 | 12/2018 | Turner | |
| 10,433,628 | B2 | 10/2019 | Palmer | |
| 10,779,632 | B2 | 9/2020 | Roberts | |
| 10,786,059 | B1 * | 9/2020 | DoCouto | A45D 44/04 |
| 10,918,192 | B1 * | 2/2021 | Wilmot | A45D 44/14 |
| D1,036,780 | S * | 7/2024 | Griffin | D6/680 |
| D1,060,829 | S * | 2/2025 | Yang | D28/93 |
| 2005/0109367 | A1 * | 5/2005 | Smith | A45D 44/14 132/333 |
| 2006/0289368 | A1 * | 12/2006 | Abney | A45D 44/06 211/13.1 |
| 2009/0008347 | A1 * | 1/2009 | Bell | A47F 5/02 211/183 |
| 2014/0191634 | A1 * | 7/2014 | Smiley | D01G 7/12 248/205.2 |
| 2015/0257515 | A1 * | 9/2015 | Bernard | F16M 11/28 211/33 |
| 2015/0351574 | A1 | 12/2015 | Eslami | |
| 2017/0105501 | A1 * | 4/2017 | Palmer | A45D 44/04 |
| 2017/0273427 | A1 * | 9/2017 | Karambatsos | A45D 20/14 |
| 2019/0053609 | A1 * | 2/2019 | Turner | F16M 11/16 |
| 2019/0090615 | A1 * | 3/2019 | Ohlgart | F16B 47/00 |
| 2019/0216208 | A1 * | 7/2019 | Roberts | A45C 13/42 |
| 2019/0313772 | A1 * | 10/2019 | Lucero | A45D 44/00 |
| 2020/0107629 | A1 * | 4/2020 | Davis | A45D 44/04 |
| 2020/0297099 | A1 * | 9/2020 | Grant | A45D 44/04 |
| 2020/0315324 | A1 * | 10/2020 | Fox | A45D 19/00 |

OTHER PUBLICATIONS

Henshall hair extension Trolley (Year: 2018).*

Hair Extension Holder—Satin Lined Storage Case With Handle Hanger Keeps Your & online _ eBay, https://www.ebay.com/p/Hair-Extension-Holder-Satin-Lined-Storage-Case-With- . . . .

Hair Works 4-in-1 Hair Extension Style Caddy Lightweight-Waterproof-Portable! 635346897269_eBay a, https://www.ebay.com/itm/Hair-Works-4-in-1-Hair-Extension-Style-Caddy- . . . .

Hair Works 4-in-1 Hair Extension Style Caddy Lightweight-Waterproof-Portable! 635346897269_eBay b, https://www.ebay.com/itm/Hair-Works-4-in-1-Hair-Extension-Style-Caddy- . . . .

Hair Works 4-in-1 Hair Extension Style Caddy Lightweight-Waterproof-Portable! 635346897269_eBay c, https://www.ebay.com/itm/Hair-Works-4-in-1-Hair-Extension-Style-Caddy- . . . .

Wig Hangers Hair Extension Carrier Storage Case Wig Stands Dust Proof Bag Black, https://www.ebay.com/i/142739279630?cnn=ps.

Unboxing: Hair Extension Organizer Stand—DoctoredLocks.com Link: https://www.youtube.com/watch?v=eAoEfE2Gung (Year: 2016).

https://www.doctoredlocks.com/hair-extension-stand.html (2016).

https://web.archive.org/web/20200927130908/https://www.henshallhair.com.au/hair-extensions/tools/ (Oct. 26, 2021).

* cited by examiner

HAIR EXTENSION BAR COMB TOOL AND METHOD OF USE

CROSS REFERENCE TO RELATED APPLICATIONS

This Patent Application claims the benefit of U.S. Non-Provisional patent application Ser. No. 16/411,895 filed on May 14, 2019, wherein: U.S. Non-Provisional patent application Ser. No. 16/411,895 claims the benefit to U.S. Provisional Patent Application Ser. No. 62/702,565, filed on Jul. 24, 2018.

FIELD OF THE INVENTION

The present invention relates to a hair extension bar comb tool and a storage bag for hair extensions with an interior comb hanger. More specifically, the present invention relates to a hair extension comb tool and a respective method of use thereof, where hair extensions are woven through teeth extending upward from one or both of a pair of combs and a top surface and each of associated side surfaces support and provide backing for hair strands of the hair extension during washing, drying, styling, coloring, etc.

BACKGROUND OF THE INVENTION

There is a need for a system wherein one or more hair extensions can be mounted on a stand such that the stylists can color or treat the mounted hair. Typically, a stylist needs two hands for any coloration process and does not have a third hand to hold the hair weft or extension. Further, there is a need to have an easy-to-clean base, bar or platform upon which is mounted the hair extension prior to coloration. Prior art systems do not provide sufficient functionality.

A prior art "Wig Hangers Hair Extension Carrier Storage Case Wig Stands Dust Proof Bag Black" is disclosed at <https://www.google.com/search?source=hp&ei=xdmCXK6JFbLb5gLvgo7IBg&q=ebay+hai r+exension+wig+storage+bag&btnK=Google+Search&oq=ebay+hair+exension+wig+storage+bag&gs_1=psy-ab.3..33il0i29912.981.11992..12257 . . . 0.0..0.259.2499.32jlj1. . . .2..0. . . .1..gws-wiz. . . ..0..0i131j0j33i160j0i13j0i13i30j0i22i30j0i8i13i30j33i22i10i29i30j33i10j33il0i160.W9pcP2vcwNs> (captured Mar. 8, 2019). This Wig Hanger, when opened, presents a vertically oriented, generally rectangular flat surface with a semi-circular top edge and hanger extending slightly above the semi-circular top edge. A horizontal bar, which appears to be a two-piece bar which can swing open at one edge or pinch the hair extension between the two pieces, grasps the top weft edge of the hair extension. The extension hair extending vertically down from the pinch bar can be forced into a transparent pocket formed below the pinch bar. Apparently, the Wig Hanger can be folded onto itself along a central vertical crease running from the apex of the semi-circular top edge and hanger to the lower edge of the Wig Hanger. No comb is used to hold the hair extensions.

A "Hair Extension Holder—Satin Lined Storage Case With Handle Hanger Keeps Your" is disclosed at <https://www.ebay.com/p/Hair-Extension-Holder-Satin-Lined-Storage-Case-With-Handle-Hanger-Keeps-Your/11027611977?iid=153343144106&chn=ps> (captured Mar. 8, 2019). This Hair Extension Holder, when opened, presents a vertically oriented, rectangular flat surface with a hanger extending above the top edge of the rectangular flat surface. A series of horizontal bands near the top edge region supports mid-section portions of hair extensions. A lower portion of these "hanging" hair extensions is wrapped under a lower series of horizontal bands. When the hair extensions are captured around and beneath these upper and lower bands, the rectangular flat hanger is folded onto itself to cover the hair extensions. No comb is used to hold the hair extensions.

A "Hair Works 4-in-1 Hair Extension Style Caddy Lightweight-Waterproof-Portable" is disclosed at <https://www.ebay.com/itm/Hair-Works-4-in-1-Hair-Extension-Style-Caddy-Lightweight-Waterproof-Portable/332730577679?epid=1072042274&hash=item4d7849b30f:g:aWkAAOSwOdpXyy NU&frcectupt=true> (captured Mar. 8, 2019). The Hair Works 4-in-1 Hair Extension Style Caddy includes a tooth comb with widely spaced apart teeth. The elongated tooth comb is mounted in an interior section of a clam shell container. The Hair Works 4-in-1 Caddy has a two-piece clam shell construction. The hair extension tooth comb extends from an interior surface of a first clam shell element, the hair extension is mounted on the elongated tooth comb, and then the second clam shell element is closed. The second clam shell element is pivotally attached to the first clam shell element. The extension hair extends outboard from the bottom of the closed clam shell structure. The stylist can then wash, color and dry the extension hair extending outboard from the bottom of the closed clam shell structure.

OBJECTS OF THE INVENTION

It is an object of the invention to provide a hair extension bar comb tool permitting the stylist to mount hair extensions thereon for further treatment, colorization, highlighting, washing and drying.

It is a further object to permit such hair extension bar comb to be mounted above a floor or table.

It is an additional object to provide a storage bag for hair extensions.

BRIEF SUMMARY OF THE PRESENT INVENTION

The hair extension bar comb retains a hair extension thereon and is adapted to be removably mounted to a floor or table stand. The hair extension bar comb has an elongated base having laterally spaced apart, generally parallel side regions. First and second comb teeth rows are respectively mounted on corresponding, laterally spaced apart, parallel side regions. Each comb teeth row has a multiplicity or a plurality of teeth. A portion of these teeth in at least one comb teeth row captures extension hair therein. In one embodiment, the hair extension bar comb includes a mounting coupler adapted to removably attach the base to a floor or table stand.

The comb teeth row defines a plurality aligned of teeth to enable a coloration process on captured extension hair in the lateral space between the first and the second comb teeth rows and between the laterally spaced apart first and second top side regions.

The storage bag for hair extensions includes an elongated bag having an upper edge lip and an upper closure system substantially along the upper edge lip. The elongated bag defines an elongated vertical bag cavity beneath the upper edge lip. A horizontal bar is mounted near the upper bag edge lip. A substantially horizontal comb teeth row is mounted on the horizontal bar. The comb teeth row includes a plurality aligned of teeth either horizontally extending from the horizontal bar or extending at an acute angle with respect to the bar. At least a portion of the comb teeth capture the extension hair such that the extension hair falls down into the vertical bag cavity for storage therein.

In a first aspect, the present invention provides an apparatus for aiding a hair stylist when working on a hair extension, the apparatus comprising:

an elongated platform comprising a first side surface, a second side surface and a top surface extending between an upper edge of the first side surface and an upper edge of the second side surface;

a series of comb teeth extending upward from the top surface, wherein the series of comb teeth are spatially arranged along an elongated direction of the elongated platform; and at least one magnetically charged element carried by at least one of the first side surface and the second side surface.

In a second aspect, the at least one magnetically charged element is inlayed within the at least one of the first side surface and the second side surface.

In another aspect, the at least one magnetically charged element is flush with the at least one of the first side surface and the second side surface.

In yet another aspect, the at least one magnetically charged element is proud from the at least one of the first side surface and the second side surface.

In yet another aspect, the at least one magnetically charged element extends substantially along an elongated length of the at least one of the first side surface and the second side surface.

In yet another aspect, the at least one magnetically charged element is located proximate at least one end of the at least one of the first side surface and the second side surface.

In yet another aspect, a pin receiving member is carried by the top surface.

In yet another aspect, a pin receiving member is carried by the top surface, the pin receiving member being located on one side of the series of comb teeth.

In yet another aspect, a pin receiving member is carried by the top surface, the pin receiving member being located on both sides of the series of comb teeth.

In a first variant, the present invention provides an apparatus for aiding a hair stylist when working on a hair extension, the apparatus comprising:

an elongated platform comprising a first side surface, a second side surface, a top surface extending between an upper edge of the first side surface and an upper edge of the second side surface, a first end surface located at a first end surface of the elongated platform and a second end surface located at a second, opposite end of the elongated platform;

a series of comb teeth extending upward from the top surface, wherein the series of comb teeth are spatially arranged along an elongated direction of the elongated platform; and at least one magnetically charged element carried by at least one of the first end surface and the second end surface.

In yet another aspect, the at least one magnetically charged element is inlayed within the at least one of the first end surface and the second end surface.

In yet another aspect, the at least one magnetically charged element is flush with the at least one of the first end surface and the second end surface.

In yet another aspect, the at least one magnetically charged element is proud from the at least one of the first end surface and the second end surface.

In yet another aspect, the at least one magnetically charged element extends substantially along an elongated length of the at least one of the first end surface and the second end surface.

In yet another aspect, the at least one magnetically charged element is located proximate at least one end of the at least one of the first end surface and the second end surface.

In another variant, the present invention provides an apparatus for aiding a hair stylist when working on a hair extension, the apparatus comprising:

an elongated platform comprising a first side surface, a second side surface and a top surface extending between an upper edge of the first side surface and an upper edge of the second side surface;

a first series of comb teeth extending upward from the top surface, wherein the first series of comb teeth are spatially arranged along an elongated direction of the elongated platform; and a second series of comb teeth extending upward from the top surface, wherein the second series of comb teeth are spatially arranged along an elongated direction of the elongated platform.

In yet another aspect, the first series of comb teeth and the second series of comb teeth are substantially parallel with one another.

In yet another aspect, the first side surface and the second side surface extend outward and downward from each respective edge of the top surface.

In yet another aspect, the first side surface and the second side surface are planar.

In yet another aspect, the first side surface and the second side surface are arched.

In yet another aspect, the elongated platform has a square cross section shape.

In yet another aspect, the elongated platform has a rectangular cross section shape.

In yet another aspect, the elongated platform has a rounded rectangular cross section shape.

In yet another aspect, the elongated platform has a trapezoidal cross section shape.

In yet another aspect, the elongated platform has a semicircular cross section shape.

In yet another aspect, the elongated platform has a semi-elliptical cross section shape.

In yet another aspect, the elongated platform has a circular cross section shape.

In yet another aspect, the elongated platform has an elliptical cross section shape.

In yet another aspect, the elongated platform can be segmented allowing for expansion or contraction along the elongated dimension.

In yet another aspect, the elongated platform can be segmented allowing for expansion or contraction along the elongated dimension, wherein the segments include an insert element and a receiving formation.

In yet another aspect, the elongated platform can be segmented allowing for expansion or contraction along the elongated dimension, wherein the segments include an insert element in a form of a pin and a receiving formation in a form of a bore.

In yet another aspect, a pin receiving member is carried by the top surface.

In yet another aspect, a pin receiving member is carried by the top surface and extends substantially along the elongated length of the elongated platform.

In yet another aspect, a pin receiving member is carried by the top surface and extends between the first series of comb teeth and the second series of comb teeth.

In yet another aspect, a pin receiving member is carried by the top surface and extends substantially along the elongated length of the elongated platform between the first series of comb teeth and the second series of comb teeth.

In yet another aspect, an elongated pointed member of a pin is inserted through a portion of the hair extension and seated into the pin receiving member.

In yet another aspect, the pin includes a single elongated pointed member and a grip element.

In yet another aspect, the pin includes a pair of elongated pointed members.

In yet another aspect, the pin includes a pair of elongated pointed members provided in a formation having a U shape.

In yet another aspect, the pin includes a pair of elongated members and a grip element.

In yet another aspect, the pin includes a pair of elongated members extending in a same direction from a grip element.

In yet another aspect, the elongated platform can be supported by a stand.

In yet another aspect, the elongated platform can be supported by a pipe clamp based stand.

In yet another aspect, the elongated platform can be supported by a pipe clamp based stand, wherein the pipe clamp based stand is secured to a sink faucet.

In yet another aspect, the elongated platform can be supported by a pipe clamp based stand comprising a flexible arm, wherein the pipe clamp based stand is secured to a sink faucet and the flexible arm allows positioning of the elongated platform over a sink.

In yet another aspect, the elongated platform can be supported by a pipe clamp based stand comprising a flexible arm, wherein the pipe clamp based stand is secured to a sink faucet and the flexible arm allows positioning of the elongated platform at least partially over a sink.

In yet another aspect, the present invention provides a method of supporting hair extensions, the method comprising steps of:

placing hair extensions into a hair extension bar comb assembly, the hair extension bar comb assembly comprising:

an elongated platform comprising a top working surface, the top working surface being substantially planar and extending laterally and continuously across a plane defined by top surfaces of a pair of elongated edges, and a pair of laterally spaced apart side surfaces, each side surface extending in one of (a) a direction substantially downward from each respective edge or (b) a direction generally downward and outward from each respective edge at an obtuse angle from a generally horizontal orientation, a first comb teeth row extending in a generally upward direction from a location on the elongated platform proximate a first elongated edge of the pair of elongated edges, the first comb teeth row extending in the generally upward direction from a position on the elongated platform that is one of (a) at the top working surface or (b) below the top working surface, and a second comb teeth row extending in a generally upward direction from a location on the elongated platform proximate a second elongated edge of the pair of elongated edges, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row and the bonded section of the respective hair extension rests against the top working surface at least located between the first comb teeth row and the second comb teeth row; and applying a hair processing treatment onto the bonded section of the respective hair extension.

In yet another aspect, the gaps between adjacent teeth of the first comb teeth row and gaps between adjacent teeth of the second comb teeth row are located at one of proximate or passing across the top working surface of the elongated platform, the method further comprising a step of:

positioning the first portion of strands of hair of the respective hair extension within the gap between two adjacent teeth of the first comb teeth row and resting a hair strand connecting element against the top working surface.

In yet another aspect, a third portion of strands of hair of the respective hair extension are positioned between two adjacent teeth of the second comb teeth row.

In yet another aspect, at least one of a color and a treatment are applied to the strands of hair of the hair extension while the hair extension is supported by the hair extension bar comb assembly.

In yet another aspect, backing support is provided to the hair extension during the step of applying at least one of a color and a treatment to the strands of hair of the hair extension, the backing support being provided by at least one of:

(a) the top surface, (b) a first side surface of the pair of laterally spaced apart side surfaces, and (c) a second side surface of the pair of laterally spaced apart side surfaces.

In yet another aspect, the elongated platform is supported by a support member

In yet another aspect, the present invention provides a method of supporting hair extensions, the method comprising steps of:

placing hair extensions into a hair extension bar comb assembly, the hair extension bar comb assembly comprising:

an elongated platform comprising a top working surface and a pair of laterally spaced apart side surfaces, each side surface extending in one of (a) a direction generally downward from a respective one of a first transition region or a second transition region or (b) a direction generally downward and outward from a respective one of a first transition region or a second transition region at an obtuse angle from a generally horizontal orientation, a first comb teeth row extending in a generally upward direction from a location on the elongated platform proximate the respective one of the first transition region or the second transition region, the first comb teeth row extending in the generally upward direction from a position on the elongated platform that is one of (a) at the top working surface or (b) below the top working surface, and a second comb teeth row extending in a generally upward direction from a location on the elongated platform proximate the respective other of the first transition region or the second transition region, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row;

arranging and treating the hair extensions in accordance with at least one of:

(a) locating the bonded section of the respective hair extension to rest against the top working surface located between the first comb teeth row and the second comb teeth row and applying a hair processing treatment onto the bonded section of the respective hair extension, and.

(b) securing a backing sheet to the elongated platform, locating the strands of hair of the hair extension to rest against the backing sheet, and applying the hair processing treatment onto the strands of hair of the respective hair extension resting against the backing sheet.

In yet another aspect, the present invention provides a method of supporting hair extensions, the method comprising steps of:

placing hair extensions into a hair extension bar comb assembly, the hair extension bar comb assembly comprising:

an elongated platform comprising a top working surface, the top working surface being substantially planar and extending laterally and continuously across a plane defined by top surfaces of and a pair of laterally spaced apart side surfaces, each side surface extending in a direction generally substantially downward and outward from a respective one of a first transition region or a second transition region at an obtuse angle from a generally horizontal orientation, a first comb teeth row extending in a generally upward direction from a location on the elongated platform proximate the respective one of the first transition region or the second transition region, the first comb teeth row extending in the generally upward direction from a position on the elongated platform that is one of (a) at the top working surface or (b) below the top working surface, and a second comb teeth row extending in a generally upward direction from a location on the elongated platform proximate the respective other of the first transition region or the second transition region, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension to rest against the top working surface at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row; and applying a hair processing treatment onto the bonded section of the respective hair extension.

These and other aspects, features, and advantages of the present invention will become more readily apparent from the attached drawings and the detailed description of the preferred embodiments, which follow.

BRIEF DESCRIPTION OF THE DRAWINGS

Further objects and advantages of the present inventions are discussed in the connection with the detailed description of the embodiments when taken in conjunction with the accompanying drawings.

DETAILED DESCRIPTION OF THE PRESENT INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
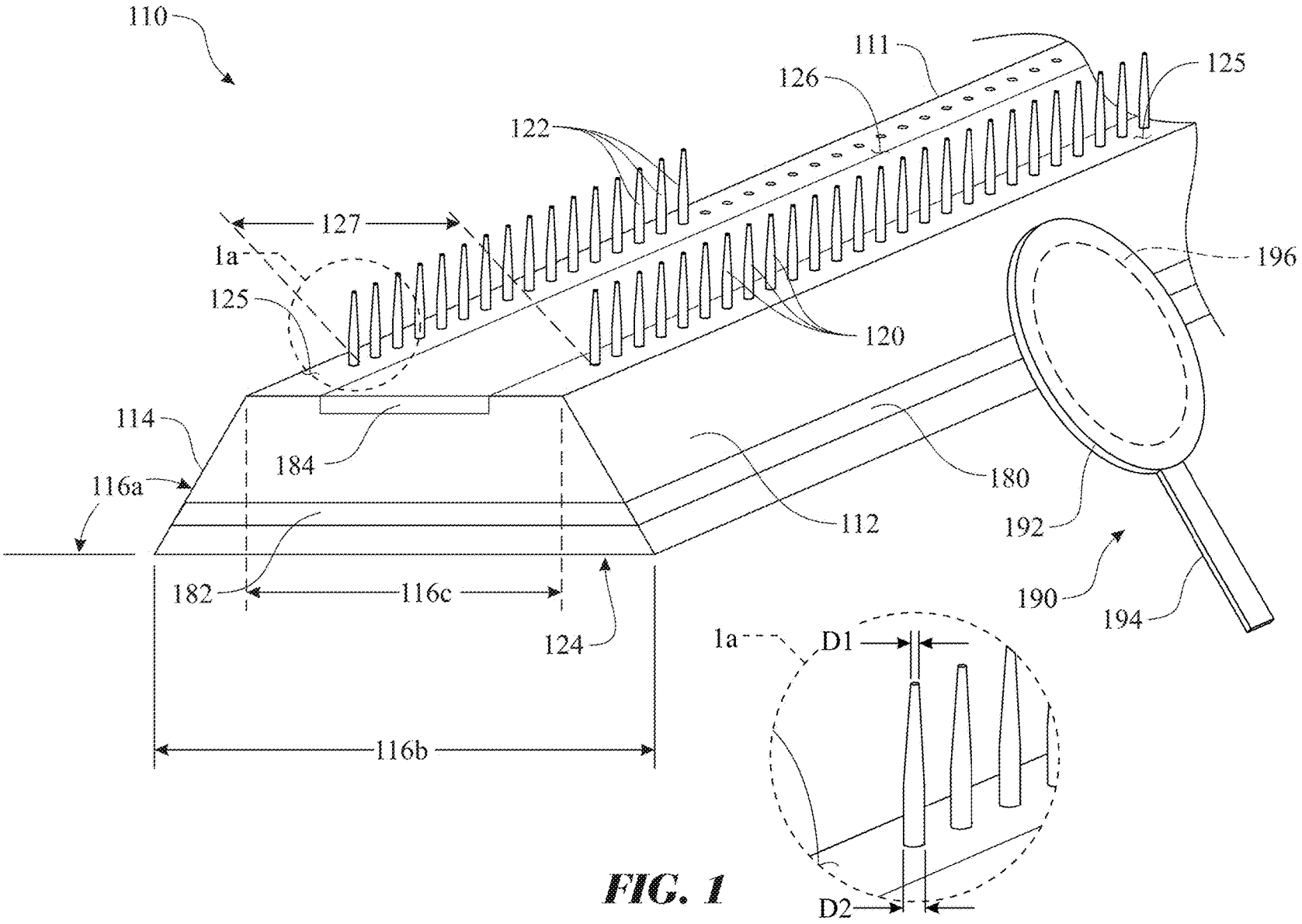
FIG. 1 presents an isometric side view of a first exemplary hair extension bar comb tool.
Figure 4:
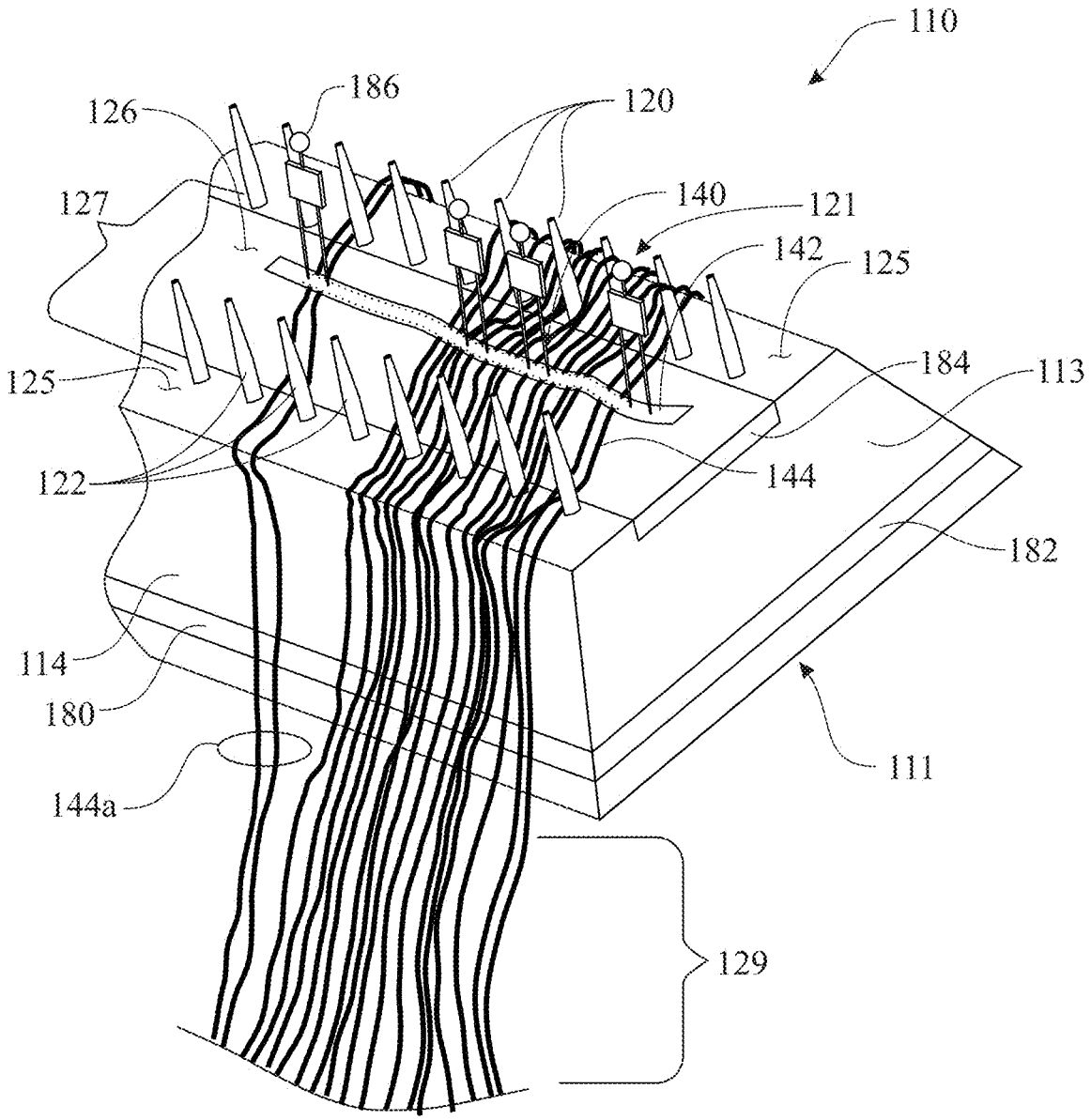
FIG. 4 presents an isometric side view of a section of a hair extension weft centered on a flat working region located between a first comb row and a second comb row of the exemplary hair extension bar comb tool originally introduced in FIG. 1.

FIG. 1 diagrammatically illustrates a hair extension bar comb tool 110. A hair extension bar 111 of the comb tool 110 ("hair extension bar comb tool 110") has a generally planar bottom or lower surface 124 and a parallel, generally planar top surface 126. The hair extension bar/platform 111 is sometimes referred to as an elongated platform 111. Sloped sides 112, 114 of the bar/platform 111 depend from the planar top surface 126 at an obtuse angle 116*a*. This angle is approximately 60°. Two sets of comb teeth 120, 122 extend upward from upper surface 126 of the platform in a generally vertical direction. Each comb tooth 120, 122 is preferably shaped having a size of a cross sectional shape at a free distal end that is smaller than a size of a cross sectional shape at an attachment end of each comb tooth 120, 122. A lateral span 116*c* of the upper surface 126 is less than a lateral span 116*b* of the lower surface of the comb tool 110. In one embodiment, tool 10 is mounted on a stand 150 (FIG. 10) and is substantially horizontal while in use. However, the hair extension bar comb tool 110 is designed to be removed from the stand 150 (FIG. 10) at times to facilitate washing (similar to the process illustrated in FIG. 13) and drying (similar to the process illustrated in FIG. 14) and transporting of a comb-mounted hair extension 140 (FIG. 4). Each of the two sets of comb teeth 120, 122 are preferably formed having a plurality of elongated members or teeth extending upward from a backing section. Each of the two sets of comb teeth 120, 122 can be molded of a plastic material, cast of a metallic material, or formed of any other suitable material using any suitable fabrication process. Multiple combs can be placed in a row to form each of the two sets of comb teeth 120, 122. The backing section can be inserted into a groove formed in the top surface 126 of the hair extension bar/platform 111. In an alternative configuration, each of the two sets of comb teeth 120, 122 can include a series of elongated members or teeth which are individually set into a respective bore formed in the top surface 126 of the hair extension bar/platform 111.

Figure 10:
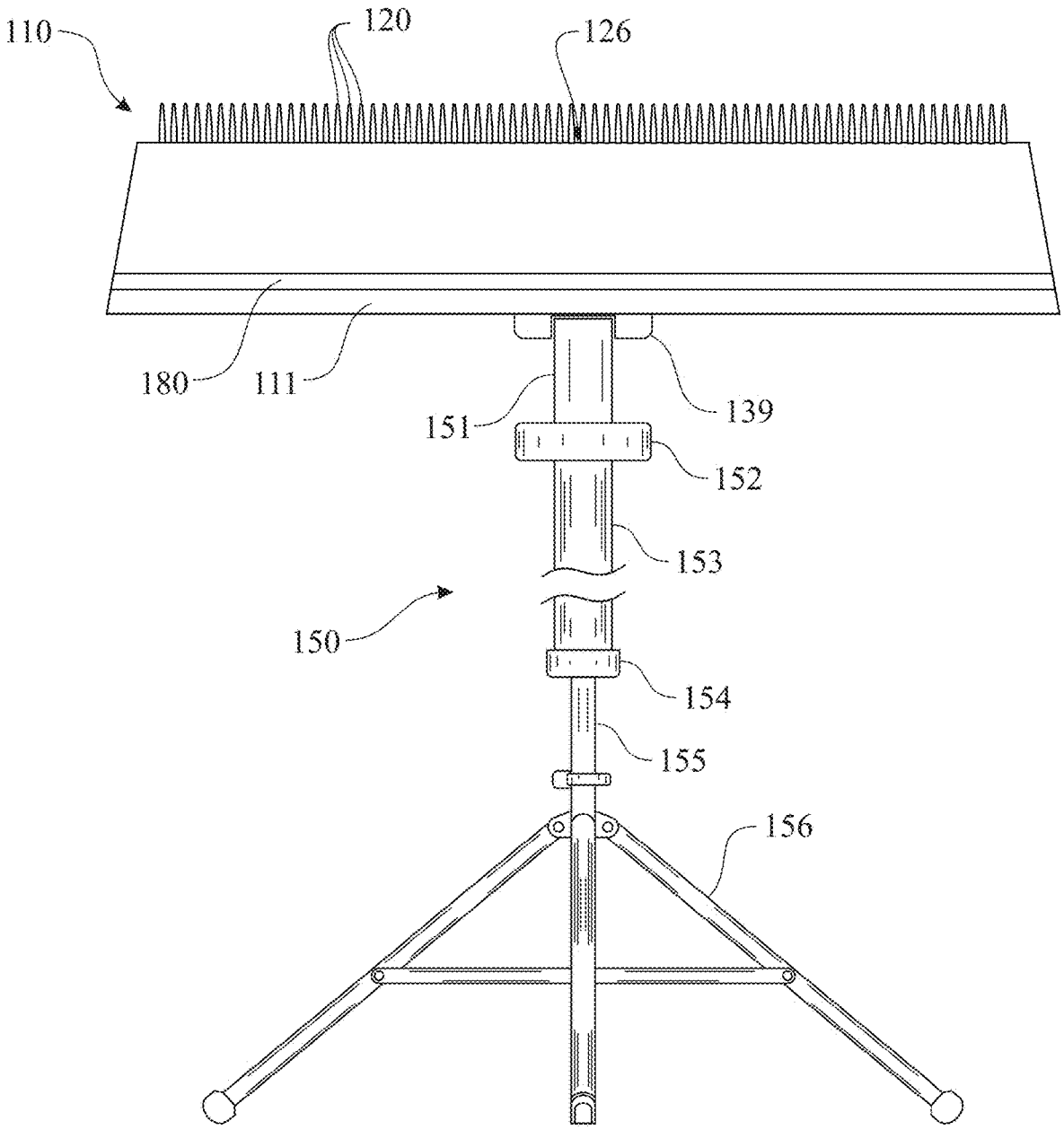
FIG. 10 presents a side view of an exemplary stand mount for the hair extension bar comb tool.

In general, the comb teeth 120, 122 extend the length of bar/platform 111. In FIG. 1, a portion of the comb teeth 122 are represented by a series of circles. FIG. 10 shows that the lower surface 124 of the bar/platform 111 includes a coupler mechanism 139 which co-acts with a complementary top stem coupler unit 151 supported by the stem 153, wherein the stem 153 extends upward from either a floor mount 150, a table mount 160 or a mannequin head mount or stand. The bar coupler 139 extending below the lower surface 124 can be configured such that it fits on a stand for a mannequin head. Rather than a floor/table stand 150, 160, the bottom of the stand stem 153 or 163 may include a clamp-down grip 166, 167 (FIG. 12), such that the hair extension bar comb tool 110 is mounted on a table top, countertop, shelf 720 (FIG. 11) and the like. When working near or requiring water 714 (FIG. 13), the hair extension bar comb tool 110 can be mounted on a pipe clamp based stand 170 (FIG. 12). In one embodiment of the comb tool 110, the hair extension bar/platform 111 is about 18-24 inches long. The bar or platform 111 includes a top planar surface 126 having a width 116*c* of about 2 inches and a bottom or lower planar surface 124 having a width 116*b* of about 3 inches. Comb teeth 120, 122 extend substantially vertically above the generally planar top surface 126 for a distance of about 1 inch.

Figure 16:
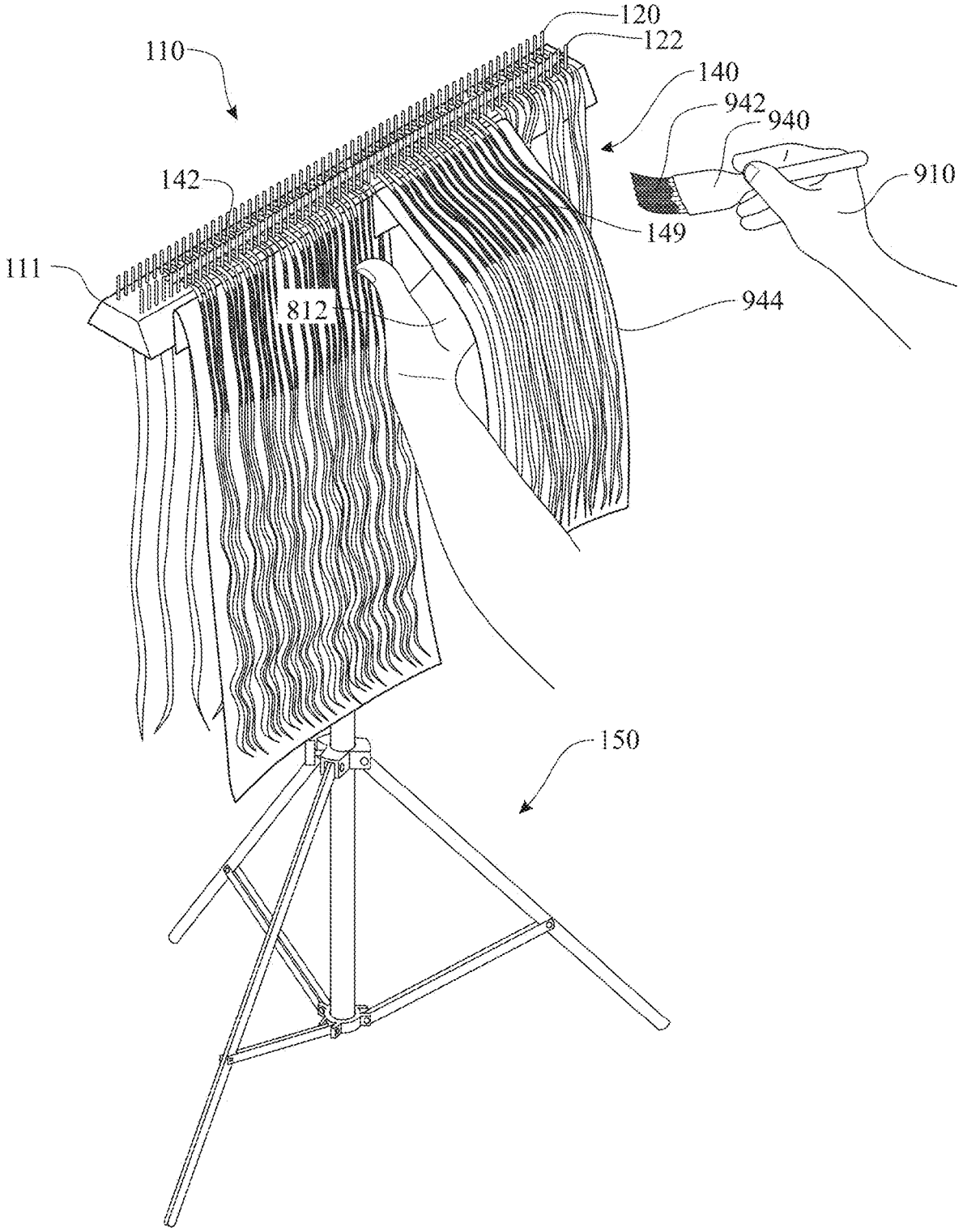
FIG. 16 presents an illustrative view of the first exemplary hair extension bar comb tool originally introduced in FIG. 1, wherein the drawing illustrates yet another exemplary use of the first exemplary hair extension bar comb tool enabling a hair stylist to color the hair extensions, while the hair extensions and hair coloring backing sheets are supported by the first exemplary hair extension bar comb tool.
Figure 17:
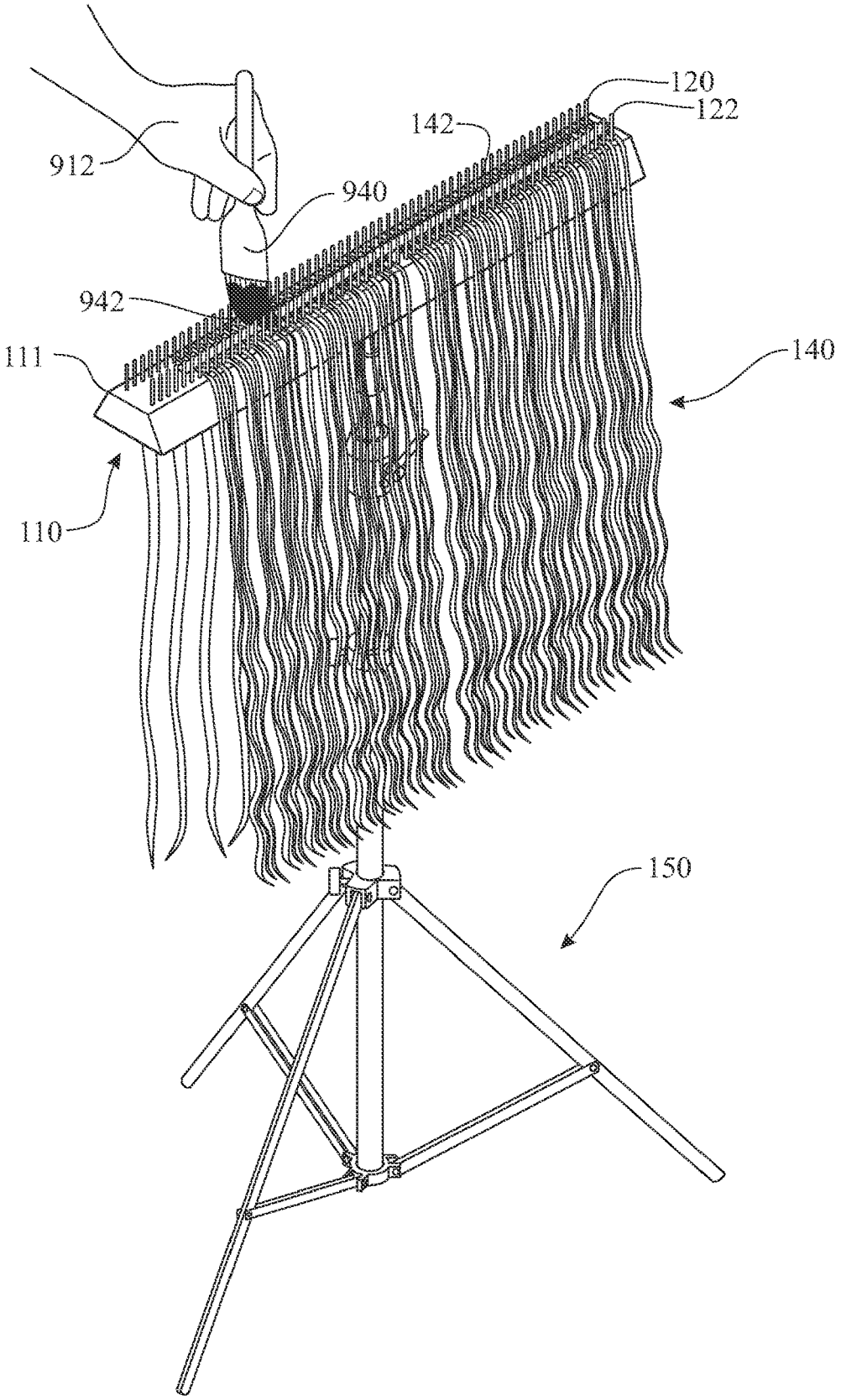
FIG. 17 presents an illustrative view of the first exemplary hair extension bar comb tool originally introduced in FIG. 1, wherein the drawing illustrates yet another exemplary use of the first exemplary hair extension bar comb tool enabling a hair stylist to color a base portions of the hair extensions, while the hair extensions, and more specifically, the base portions of the hair extension are supported by the first exemplary hair extension bar comb tool.
Figure 18:
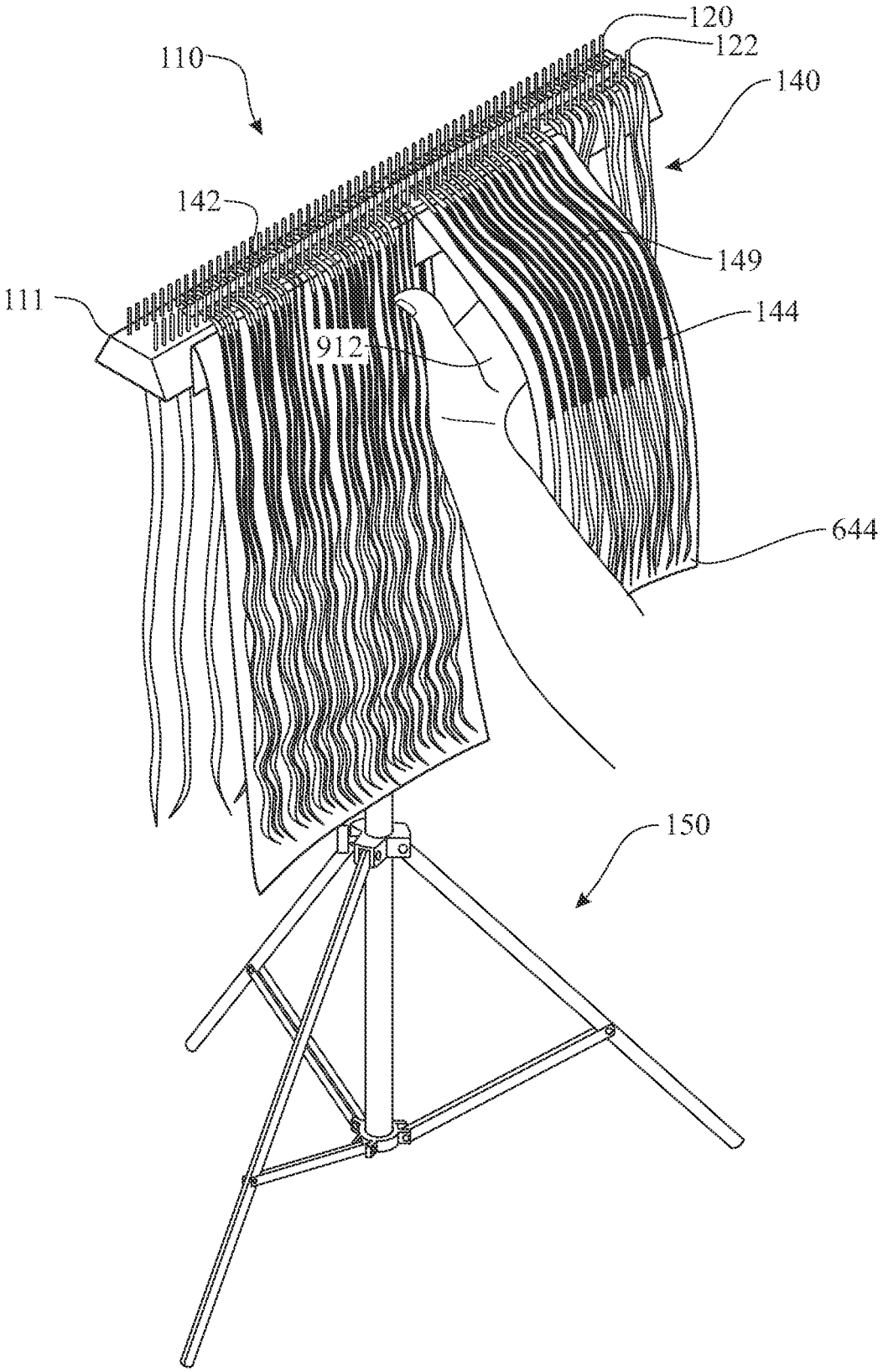
FIG. 18 presents an illustrative view of the first exemplary hair extension bar comb tool originally introduced in FIG. 1, wherein the drawing illustrates yet another exemplary use of the first exemplary hair extension bar comb tool enabling a hair stylist to color and highlight or provide multiple colors to the hair extensions, while the hair extensions and hair coloring backing sheets are supported by the first exemplary hair extension bar comb tool.

The hair extension bar comb tool 110 is a hair extension tool that allows the stylist 900 (FIG. 13) to organize placement, color and cut and style the hair extensions 140 while detached and before attachment or re-attachment to the client's head. The hair extension bar comb tool 110 is a stylist's assistant without hands. There are many times where the hair extensions 140 need to have a refresh tone applied or need to be re-colored or glossed or treated (color or other treatment 942 applied using a color applicator brush 940 as shown in FIGS. 16, 17, and 18) and then blow dried (blow dried using a hair blower 920 as shown in FIG. 14) after removal and before reinstallation on the client's head. This refresh/re-color and blow dry has become challenging for the stylist 900 and often requires two hands for the hair extension 140 and a third hand for the touch-up or colorization brush 940 and/or the blow drier 920. The hair extension bar comb tool 110 cuts refresh/re-colorization application time in half and produces an organized, clean system to keep the hair extension 140 in prime condition, that is, a de-tangled condition and gives the stylist 900 the freedom of creativity with color without a mess to clean up.

The hair extension bar comb tool 110 acts as a hair extension assistant without hands. There are six challenges in the hair extension industry and this hair extension bar comb system 110 provides a unique, inventive solution. Function: (a) color (FIGS. 16, 17, and 18) (providing colored hair 149), (b) rinse (FIG. 13) (providing washed hair 146), (c) blow dry (FIG. 14) (providing dried hair 147), (d) style (FIG. 15) (providing styled, such as curled hair 148), (e) organize the hair extension for re-placement and re-installation on the client's head; and (f) storage of the hair extension for future use and for compact organization of the finished hair extension 140 for the consumer or the stylist 900.

The hair extension bar comb tool 110 is an extension system with five unique attachments that attach to a customized base that allows the stylist 900 to organize placement, color (FIGS. 16, 17, and 18), cut and style (FIGS. 14 and 15) while the hair extension 140 is detached from the client's head.

As a hair extension artist, there are many times the challenge has presented itself where the client's hair extension 140 will need a refresh or tone not to mention recolor or a treatment (provided by applying color or other treatment 942). This is typically done during removal of the hair extension 140 because the hair extension 140 requires different treatment than the client's natural hair and usually requires two hands on stylist 900 to complete. Many times, with tape-in and keratin bond applications, there is left over hair and that hair will go unused due to color matching for other clients. This left over hair represents wasted money for the stylist 900 and the client. With the hair extension bar comb tool 110 and the hair extension storage bag 730 (FIGS. 19 and 20). this is no longer an issue. The stylist 900 will be able to use unused hair on a variety of people because they will now have the freedom to color the leftover hair (colored hair 149) to match their next client.

The comb tool 110 can be enhanced by introducing a pin receiving member 184 to an upper surface 125 of the comb tool 110. The pin receiving member 184 can remain proud or be recessed within a slot or groove. The pin receiving member 184 is preferably sized and located to span between facing surfaces of the first set of comb teeth 120 and the second set of comb teeth 122. The pin receiving member 184 can be fabricated of any material suitable of receiving pins or other thin, sharp elongated objects. It is preferred that the pin receiving member 184 is additionally resistant to staining, deters retention of any fluids, and includes any other properties that would be helpful to hair treatment processes. For example, the pin receiving member 184 can be fabricated of neoprene, rubber, cork, or any other suitable material. The pin receiving member 184 can be fabricated of a plurality of materials, such as plastic laminated over neoprene, etc. The hair stylist can place a protective material over the pin receiving member 184, such as wax paper, a thin plastic, aluminum foil or any other suitable material to provide a barrier between any treatment compositions and the pin receiving member 184.

In use, the hair stylist can insert one or more retention pins 186 through the hair weft braid or the weft carrier 142 and into the pin receiving member 184 to retain the hair extension 140 in position on the comb tool 110. The retention pin 186 can be of any suitable shape. In the exemplary illustration, the retention pin 186 include a pair of thin, pointed, elongated members. The pair of thin, pointed, elongated members can be provided as individual elements or formed in a U shape. A small plastic formation can be overmolded at a distal (non-pointed) end of each of the pair of thin, pointed, elongated members. The small plastic formation can be used to assemble a third elongated member, wherein the third elongated member extends from the small plastic formation in a direction opposite of the pair of thin, pointed, elongated members. A pin head can be provided on a distal, free end of the third elongated member, wherein the user would grip the pin head or the small plastic formation when manipulating the retention pin 186. Alternatively, the retention pin 186 can be of a more familiar pin, the retention pin 186 comprising a single thin, pointed, elongated member having a pinhead provided on the distal, free end thereof.

The pin receiving member 184 can be arranged extending between facing surfaces of the first set of comb teeth 120 and the second set of comb teeth 122 as described above. An additional section of pin receiving member 184 can be located on an opposite side of one or both of the first set of comb teeth 120 and the second set of comb teeth 122.

When the comb tool 110 includes a single set of comb teeth, the pin receiving member 184 can be located on one or both sides of the single set of comb teeth.

The pin receiving member 184 can include or be replaced by a magnetized material or magnetically attracting material to temporarily secure a hair extension 140 having a magnetic attachment design. In use, the magnetic attachment design would contact the magnetized material or magnetically attracting material, thus being retained by the magnetic attraction between the elements of the magnetic attachment design of the hair extension and the magnetized material or magnetically attracting material. Alternatively, the weft carrier 142 of the hair extension can be sandwiched between a magnetic or magnetically attracted material placed on top of the weft carrier 142 of the hair extension and the magnetized material or magnetically attracting material carried by the comb tool 110.

The hairstylist commonly employs tools to assist the hairstylist during one or more types of treatments of the hair extension 140. The comb tool 110 is enhanced by introducing a system for temporarily holding tools, such as a hair working paddle 190. A magnetized member (sidewall segment) 180 can be integrated into the comb tool 110. More specifically, in one example, one magnetized member (sidewall segment) 180 can be integrated into one or both respective sloped sides 112, 114 of the hair extension bar/platform 111. A magnetized member (end wall segment) 182 can be integrated into one or both end walls 113. The magnetized member (end wall segment) 182 can extend across an entire width of the end wall 113 (as shown) or be provided as a shape, preferably centrally located, (such as an exemplary magnetized member (end wall segment) 482 illustrated in FIG. 6).

The hair working paddle 190 is one exemplary tool. The hair working paddle 190 includes a hair working paddle handle 194 extending radially from a hair working paddle body 192. A hair working paddle supporting magnetically attracted material 196 can be integrated within at least one of the hair working paddle body 192 and the hair working paddle handle 194. A magnetic attraction between the magnetized member (sidewall segment) 180 and/or the magnetized member (end wall segment) 182 and the hair working paddle supporting magnetically attracted material 196 is sufficient to retain the hair working paddle 190 in position against the sloped side 112, 114. The magnetized member (sidewall segment) 180 and/or the magnetized member (end wall segment) 182 can additionally be shaped to introduce a mechanical retention interface in addition to or alternatively to the magnetic attraction. In one variant, the magnetized member (sidewall segment) 180 and/or the magnetized member (end wall segment) 182 can be flush with the respective surface of the hair extension bar/platform 111. In a second variant, the magnetized member (sidewall segment) 180 and/or the magnetized member (end wall segment) 182 can be proud, respective to the surface of the hair extension bar/platform 111.

The magnetic attraction is the preferred temporary attachment interface, as the magnetic interface is unlikely to be affected by chemicals used for treating hair extensions 140. Alternatives, such as a dense hook and loop tape interface, a mechanical interface, or any other suitable interface can be employed to temporarily hold a tool in place on the comb tool 110.

Figure 2:
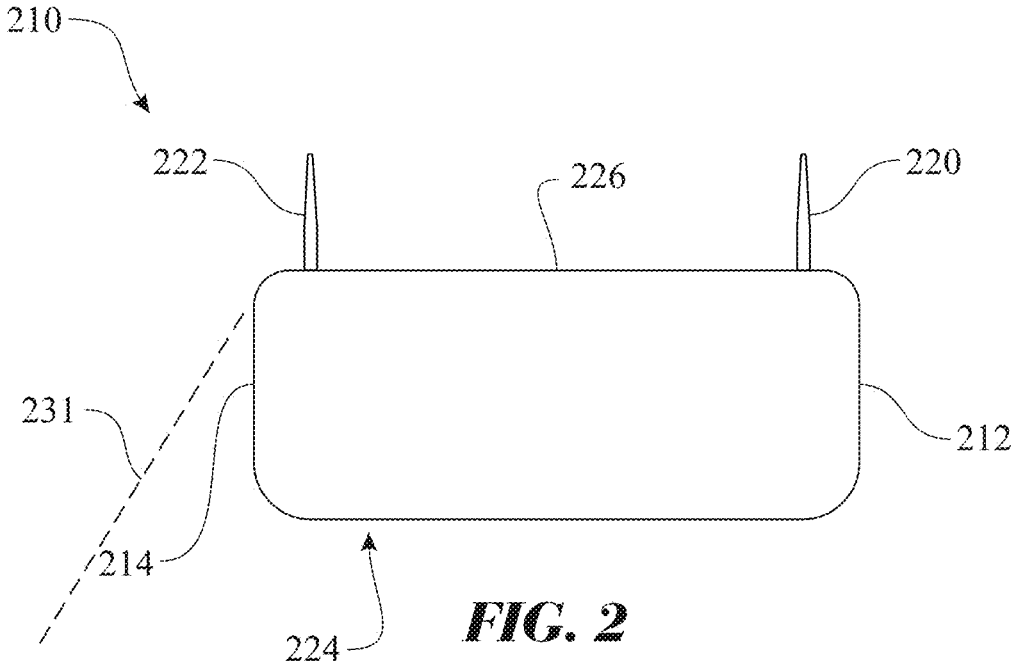
FIG. 2 presents an end view of a second exemplary hair extension bar comb tool having an alternative cross-sectional shape.
Figure 3:
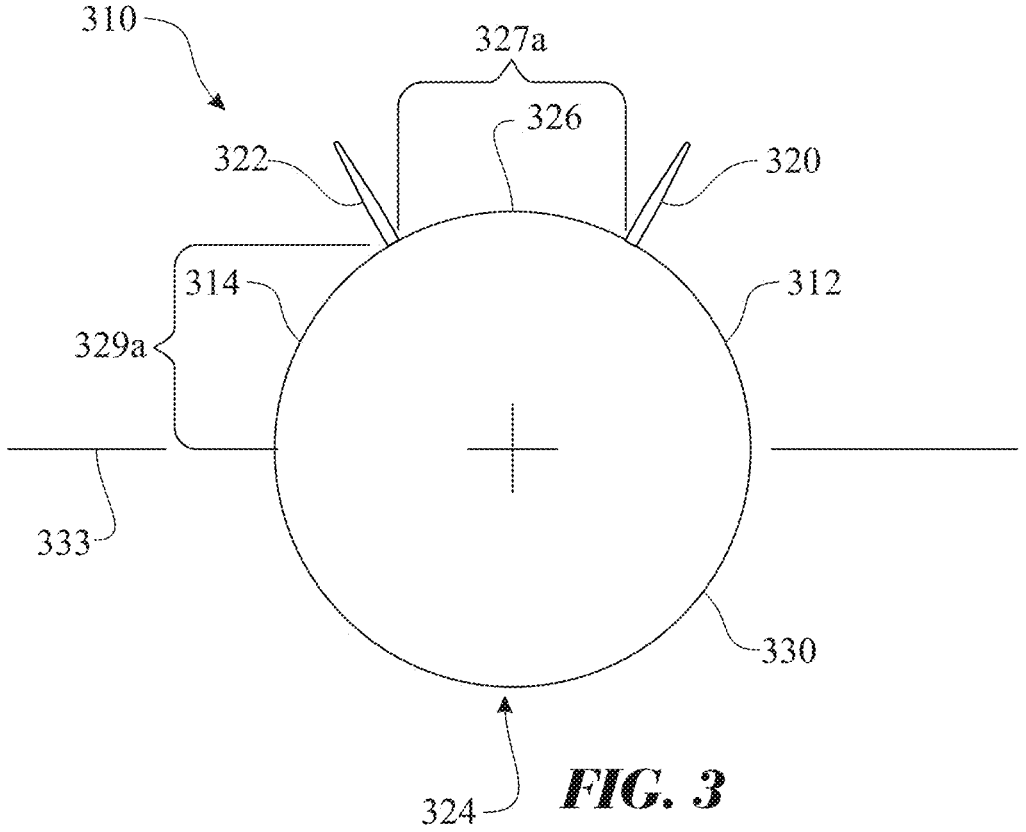
FIG. 3 presents an end view of a third exemplary hair extension bar comb tool having another alternative cross-sectional shape.
Figure 6:
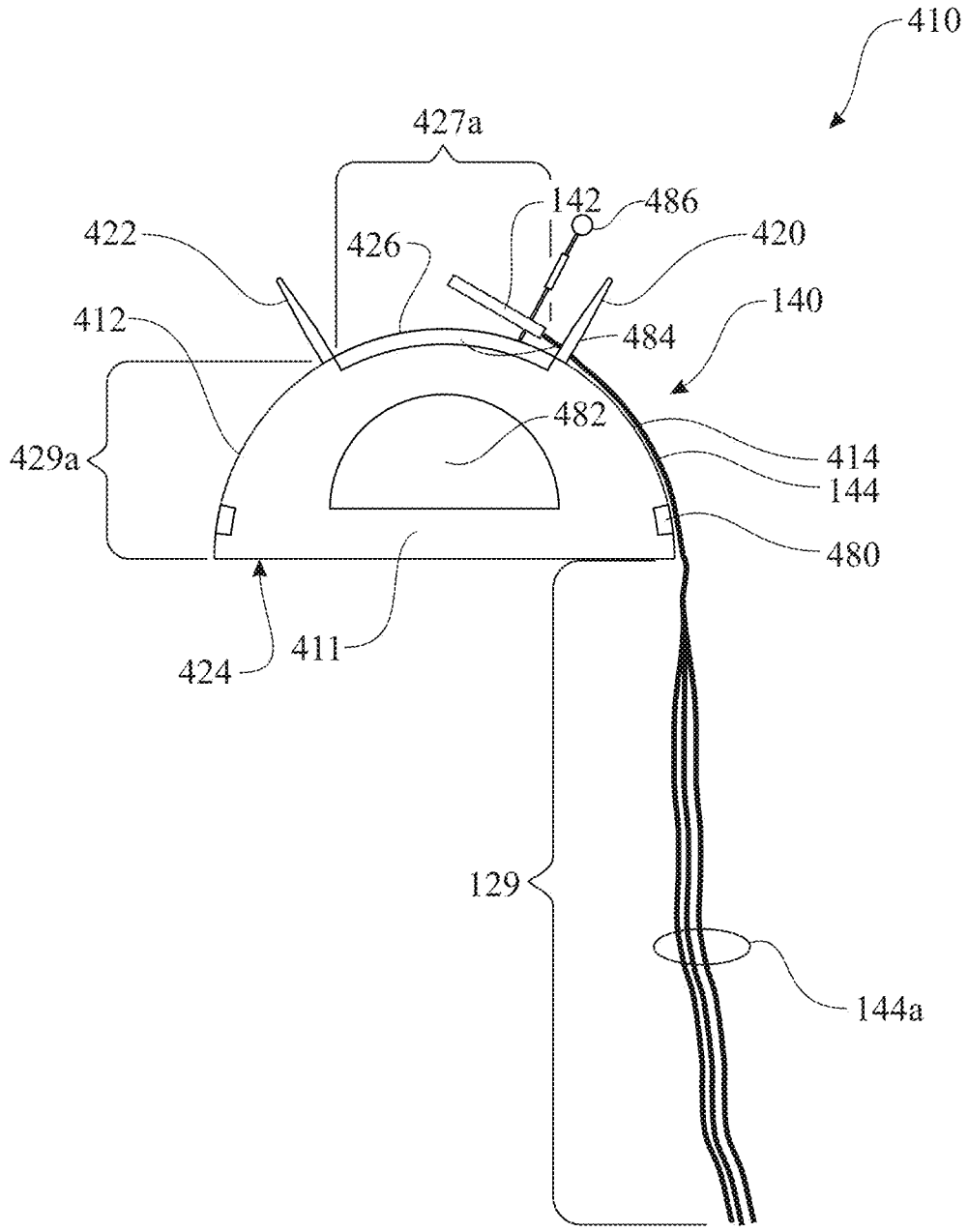
FIG. 6 presents an end view of a fourth exemplary hair extension bar comb tool having another alternative cross-sectional shape, wherein the drawing illustrates how hair of the hair extension lays against and is supported by a sidewall of the forth exemplary hair extension bar comb tool.

FIGS. 2, 3, and 6 diagrammatically illustrate alternative cross-sectional shapes for the hair extension bar comb 110. As an alternative to the quadrilateral or trapezoidal shape of the hair extension bar comb tool 110 in FIG. 1 (an isosceles trapezoid shape), a hair extension bar comb tool 210 is introduced in FIG. 2. Like elements of the hair extension bar comb tool 110 and the hair extension bar comb tool 210 are numbered the same, whereas the elements of the hair extension bar comb tool 210 are preceded by the numeral "2". The hair extension bar comb tool 210 is formed having cross section shape in a form of a rectangle with sides 212, 214 at right angles (90 degrees) to the top surface 126 or extending downward from the top surface 126. However, the absence of a slope 131 (dashed lines), referring to the sloped sides 112, 114 of the hair extension bar comb tool 110, may reduce the efficiency of the coloring task (adding color or other treatment 942) of the stylist 900 because the stylist 900 needs to pull out the hair away from the side 214.

Figure 9:
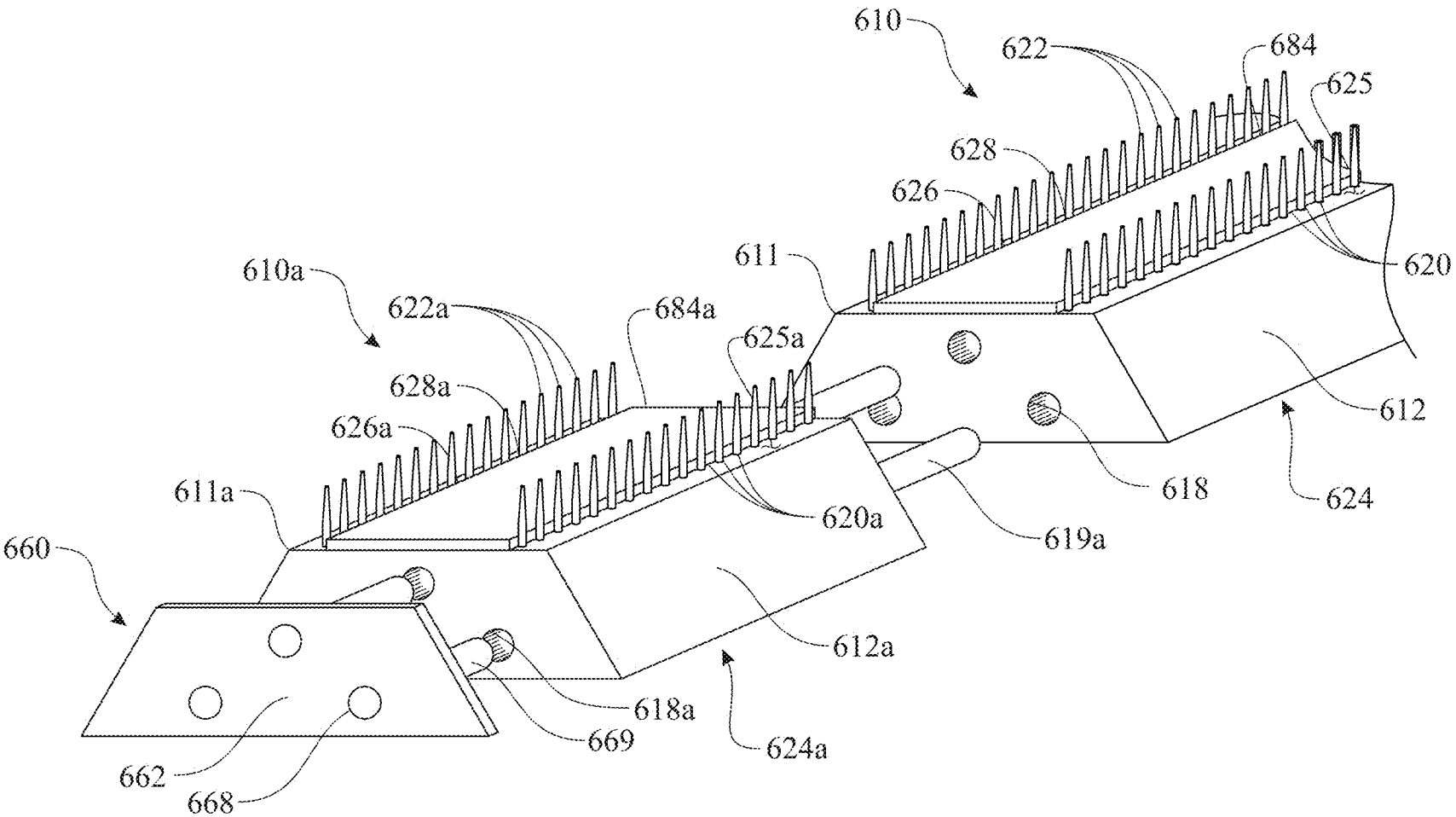
FIG. 9 presents an exploded isometric assembly of a variant of the fifth exemplary hair extension bar comb tool, wherein the drawing illustrates an enhanced, expandable variant of the fifth exemplary hair extension bar comb tool originally introduced in FIG. 7.

In another alternative to the quadrilateral or trapezoidal shape of the hair extension bar comb tool 110 in FIG. 1 (an isosceles trapezoid shape), is a circular or partly elliptical cross-sectional shape 330, which is introduced in FIG. 3. Like elements of the hair extension bar comb tool 110 and the hair extension bar comb tool 310 are numbered the same, whereas the elements of the hair extension bar comb tool 310 are preceded by the numeral "3". As for the circular or partly elliptical cross-sectional shape 330 variant of the hair extension bar comb tool 110, introduced in FIG. 3, the upper circumference (above mid-line 333) of the hair extension bar comb defines a reasonably large work region 327*a* to capture the hair weft braid 144 or the weft carrier 142, then the upper hemisphere of the hair extension bar comb in FIG. 3 may work reasonably efficiently. The circumferential distance 327*a* between comb rows 320, 322 should be adequately large to capture the hair weft braid 144 or the weft carrier 142 therebetween. The slope 329*a* may be adequate to permit the stylist 900 to apply color or treatment 942 to hair strands 144 of the extension hair 140 near, but not adjacent the hair weft braid 144 or weft carrier 142. A hemispherical shape may also be used if FIG. 3 is bisected at mid-line 333. It is understood that the hair extension bar comb tools 210, 310, 410, 510 (FIG. 7, 8), 610 (FIG. 9) can be supported by either of the stands/supports 150, 160, 170 illustrated in FIGS. 10, 11 and 12. The stylist 900 can use the hair extension bar comb tools 210, 310, 410 in the same manner as the processes described herein using the hair extension bar comb tool 110.

The lower surface 124 of hair extension bar comb tool 110 need not be parallel to upper surface 126. Although there is a benefit associated with a flat lower surface 124 when the stylist 900 washes the hair extension mounts on bar/platform 111 and when the stylist 900 carries the bar/platform 111, the lower surface 124 could be shaped in any form or manner. The lower surface 124 can include a shape to receive a mount for securing a supporting member. For example, in a design where the bottom surface 124 is not planar, the lower surface 124 can include a planar section of at least a size and shape of a mounting plate for attaching and detaching a support system, such as a stand.

The hair extension bar comb tool 110 can be made out of any durable material. The double set of comb teeth 120, 122 extend upward in a direction that is generally perpendicular to the upper flat surface 126 of the bar/platform 111. The sloped side surfaces 112, 114 depend from the upper flat surface 126 of the bar/platform 111 and arc angled to permit the stylist 900 or user to color (provided by applying color or other treatment 942) the hair 144 or blow dry the hair 144 using a hair blower 920. The hair extension bar comb tool 110 has, at its midpoint on the lower parallel flat surface 124, a coupling joint 139 (FIG. 10) which cooperates with a downward extending stem 151 (FIG. 10).

As indicated above, the hair extension bar comb tool 110 includes an elongated base 111, of various cross-sectional shapes (quadrilateral, a trapezoidal, isosceles trapezoidal, rectangular, rounded-rectangular, pentagonal, hexagonal, octagonal, circular, semi-circular, hemi-spherical, semi-elliptical, and hemispherical elliptical; see FIGS. 1 through 3) wherein two comb teeth rows 120, 122, in parallel with each other, capture extension hair from a hair extension 140 on at least a portion of teeth of one of the comb teeth rows 120, 122 (FIG. 4). As discussed, all strands of hair 144*a* of the hair extension 140 may pass through gaps between adjacent teeth of one of the comb teeth row 120, 122 and captured by one portion of one comb teeth row 120 (FIG. 4 shows two-way hair capture (rows 120, 122), but one-way hair capture (row 120) operates the same). A flat top surface 126 is helpful, but gentle curved surfaces 326 (FIG. 3), with sufficient top working region 327*a*, may also provide similar operational benefits discussed herein. The substantially flat top surface optimally has a lateral working region span of between about 0.5 inches and 4.0 inches, and typically about 1.5 inches. Sloped sides are operationally helpful and optimally provide a sloped working region of between about 0.5 inches and about 4.0 inches, and typically about 1.0-1.5 inches. The objective achieved by the parallel, spaced apart comb teeth rows 120, 122 is to provide a coloration process platform, which is working region 127, therebetween. Additionally, the sloped working region 112, 114 provides an additional coloration process platform.

The components of the hair extension bar comb tool 110 are generally classified as follows: a customized base attachment that fits onto a mannequin head stand. One 22-inch double sided, comb-like bar (bar 111 with comb teeth rows 120, 122, (FIG. 1)) with a 1-inch flat center work region 127 on top surface 126. As shown in FIG. 10, hair extension bar comb tool 110 will attach to base attachment. A second configuration of the hair extension bar comb is a 14-inch double sided, comb-like bar (bar 111 with comb teeth rows 120, 122, (FIG. 1)) with a 1-inch flat center work region 127. The bar 111 that attaches to a base and stem attachment (FIG. 10). A third configuration is a 10-inch double sided, comb-like bar with a 1-inch flat work center region 127. A fourth configuration is a collapsible placement tool which consists of 18-inch full circular comb, 22 inch full circular comb, an 11 inch and 9 inch half-moon comb. These will all connect and collapse for storage. A wig/toupee attachment with a 22 inch circular comb and a solid dome center for stability is another configuration.

As shown in FIG. 1, hair extension bar comb tool 110 has a comb bar or base 111 with two rows of comb teeth 120, 122 spaced apart and defining a working region 127 on a top surface 126 of the bar 111. A short lateral working region 125 defines the periphery of the top surface 126 between comb row 122 and the edge defining top surface 126 and sloped surface 114. A similar short lateral surface is found to the right of comb row 120 and the right edge of surface 126 and slope 112. Slopes 112, 114 define a third working region or working surface.

Figure 5:
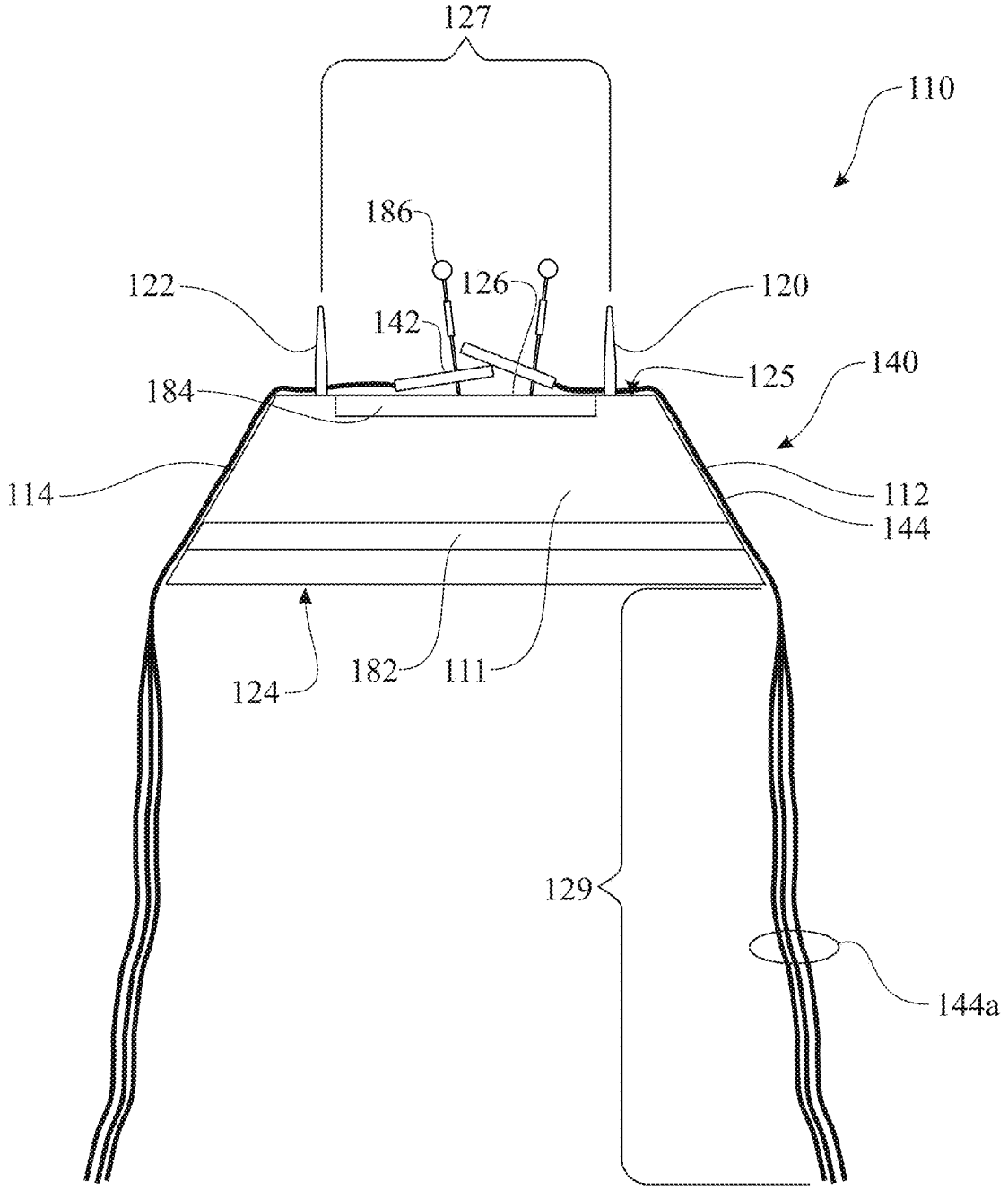
FIG. 5 presents an end view of the first exemplary hair extension bar comb tool originally introduced in FIG. 1, wherein the drawing illustrates how hair of the hair extension lays against and is supported by a sidewall of the first exemplary hair extension bar comb tool.

FIG. 4 diagrammatically illustrates a double sided version of a hair extension weft 144 centered on flat working region 126 between comb rows 120, 122. Similarly. FIG. 5 diagrammatically illustrates two single sided versions of hair extension wefts 144, each having the hair weft braid or the weft carrier 142 located within the flat working region 127 between comb rows 120, 122. Similarly, FIG. 6 diagrammatically illustrates a single sided version of hair extension weft 144, having the hair weft braid or the weft carrier 142 located within a working region 427*a* between comb rows 420, 422 of the hair extension bar comb tool 110.

In FIG. 4, the distance between each comb tooth and the serially adjacent comb tooth is exaggerated to show that extension hair 144 is laid in a gap 121 provided between adjacent comb teeth. Two hairs 144*a* are diagrammatically illustrated to show the utility of the flat working region 127 on top surface 126, the short side-lateral working regions and the slope 114. In use, the density of the hair falling from hair extension weft carrier 144 is too dense to show in the line drawings of this disclosure. In FIG. 4, the extension hair is placed in both rows of comb teeth 120, 122; however the extension hair may be placed in either comb teeth row 120 or comb teeth row 122. Sometimes, pins are needed to affix hair extension weft carrier 144 to the top surface 126.

The illustration presented in FIG. 5 demonstrates how the sloped sides 112, 114 backs or supports the strands of hair 144*a* of the hair extension 140. The support provided by the sloped sides 112, 114 enables the hair stylist 900 to apply pressure to the hair strands 144*a*.

The illustration presented in FIG. 6 demonstrates how an arched side surface 412, 414 of another exemplary comb tool 410 backs or supports the strands of hair 144*a* of the hair extension 140. The fourth exemplary comb tool 410 includes a hair extension bar/platform 411 having an arched upper surface (preferably semicircular) 412, 414 and a generally planar bottom surface 424. The fourth exemplary comb tool 410 includes a pair of comb teeth 420, 422 extending radially outward from the arched upper surface (preferably semicircular) 426. A circumferential distance between comb rows 427*a* extends between each of the first set of comb teeth 420 and the second set of comb teeth 422. A portion of the arched upper surface (preferably semicircular) 426 extending downward from each of the comb teeth 420, 422 defines a slope 429*a*. The support provided by the slope portion 429*a* (comprising side surfaces 412, 414) of the arched upper surface (preferably semicircular) 426 enables the hair stylist 900 to apply pressure to the hair strands 144*a*.

Figure 7:
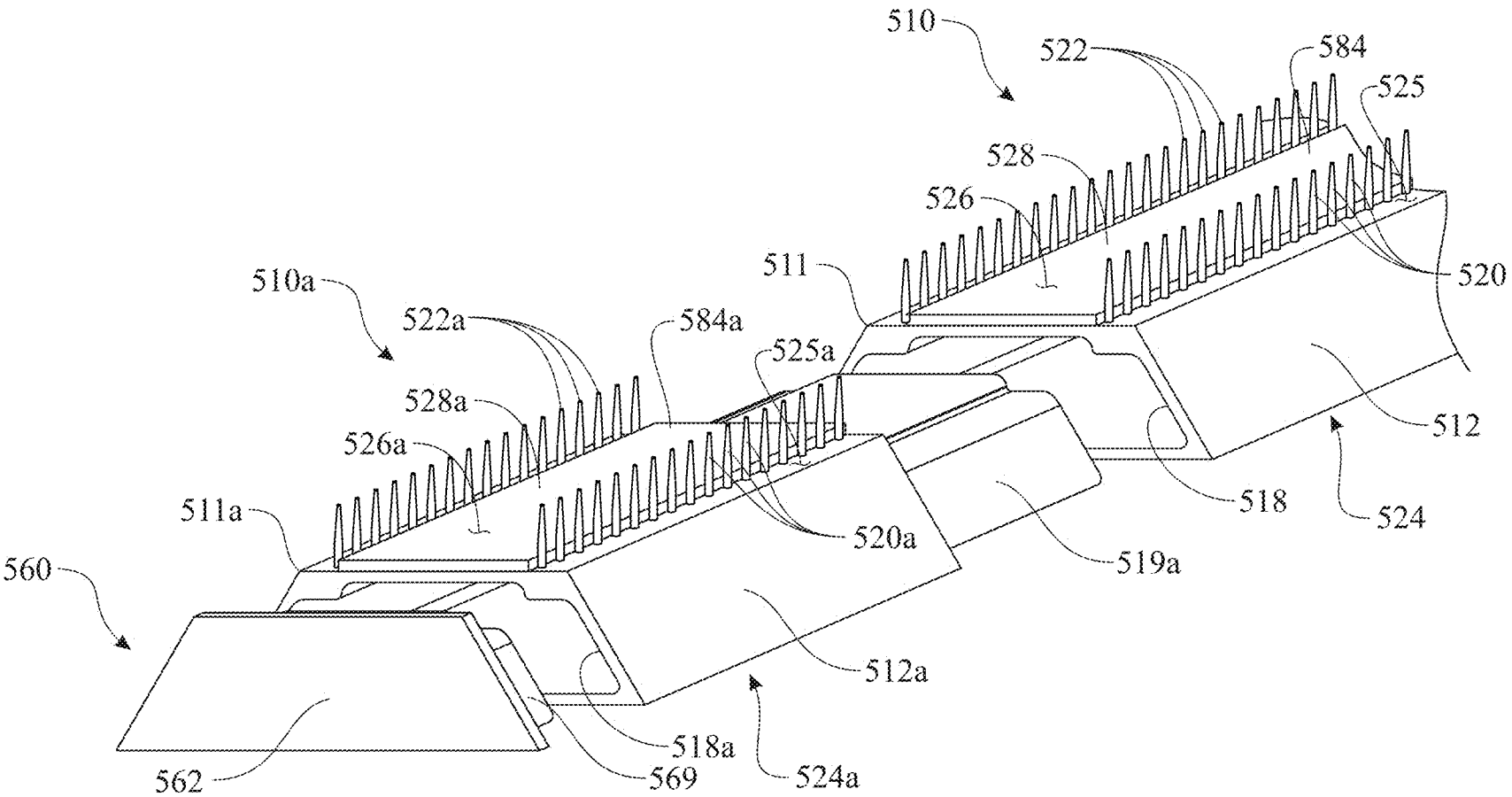
FIG. 7 presents an exploded isometric assembly of a fifth exemplary hair extension bar comb tool, wherein the drawing illustrates an enhanced, expandable variant of the first exemplary hair extension bar comb tool originally introduced in FIG. 1.
Figure 8:
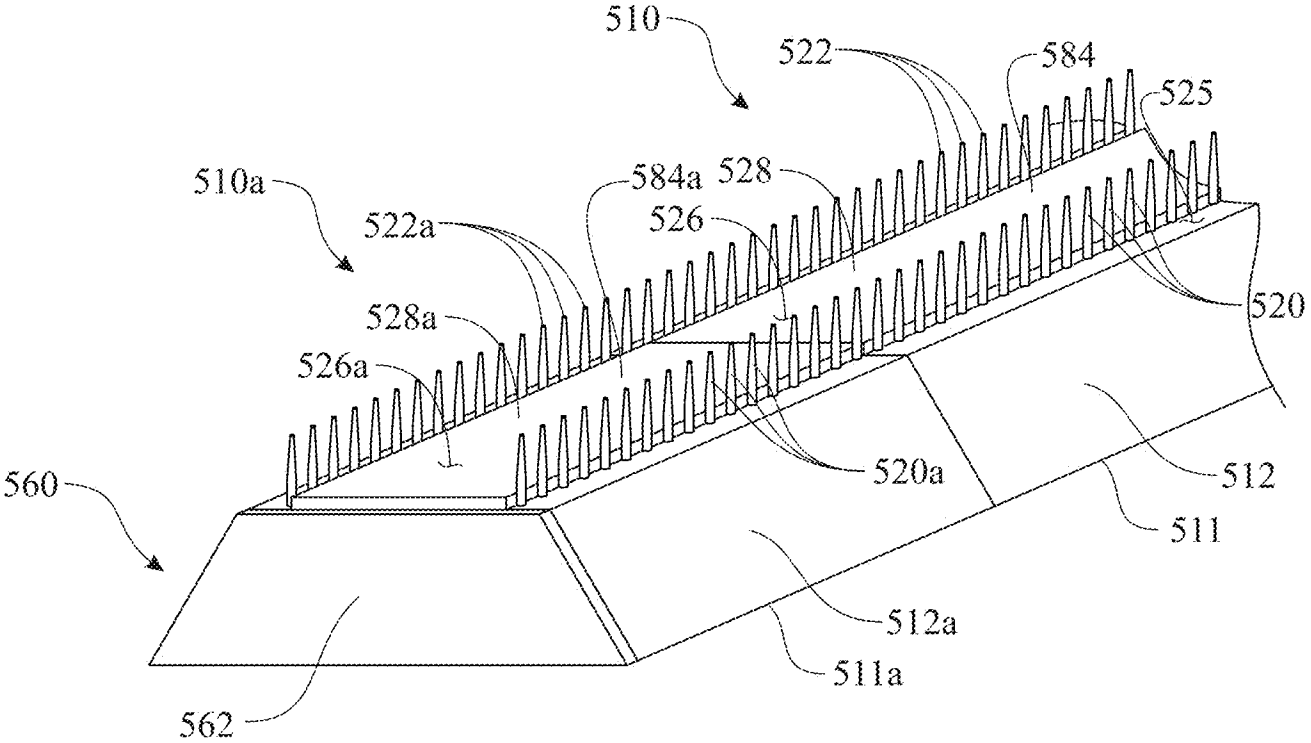
FIG. 8 presents an isometric assembly of the fifth exemplary hair extension bar comb tool originally introduced in FIG. 7.

The exemplary comb tools 110, 210, 310, 410 can be enhanced by introducing an extension feature, as presented in an exemplary extendable comb tool 510 illustrated in FIGS. 7 and 8. Although the exemplary comb tool 510 replicates the comb tool 110, it is understood that the concept can be applied to any of the exemplary comb tools 110, 210, 310, 410. Like elements of the hair extension bar comb tool 110 and the extendable hair extension comb tool 510 are numbered the same, whereas the elements of the extendable hair extension bar comb tool 510 are preceded by the numeral "5". A hair extension comb tool extension 510*a* and the exemplary comb tool 510 comprise a number of like elements. Like elements of the extendable hair extension bar comb tool 510 and the hair extension comb tool extension 510*a* are numbered the same, whereas the elements of the hair extension comb tool extension 510*a* are succeeded by the letter "a".

The extendable hair extension comb tool 510 includes at least one comb tool extension platform assembly insert receiving cavity 518, which can extend inward from one or both ends of the extendable hair extension comb tool 510. In the exemplary embodiment, the comb tool extension platform assembly insert receiving cavity 518 is similar in shape to the exterior surface of the extendable comb tool 510. The comb tool extension platform assembly insert receiving cavity 518 can be formed as a bore or cavity, having an end wall or formed as a hollow member where the comb tool extension platform assembly insert receiving cavity 518 extends through the length of the extendable hair extension comb tool 510. The comb tool extension 510*a* includes a comb tool extension platform assembly insert 519*a*, which is of a size and shape for engagement and insertion to the comb tool extension platform assembly insert receiving cavity 518.

The exemplary extendable comb tool 510 introduces an extendable comb tool padded top surface element 528, where the extendable comb tool padded top surface element 528 provides the extendable comb tool planar top surface 526. The extendable comb tool padded top surface element 528 can be fabricated of any suitable material, including any pliant material, foam, closed cell foam, any suitable polymer, silicone, rubber, silicone-rubber, plastic, laminated composite material, and the like. The extendable comb tool padded top surface element 528 provides several functions to the extendable comb tool 510. The extendable comb tool padded top surface element 528 provides a pliant surface for absorbing any pressure from the color applicator brush 940 or any other forces applied to the hair extensions 140. The extendable comb tool padded top surface element 528 enables insertion of pins to further restrain the hair extensions 140 from movement while being subjected to processing, during storage, or during any other applied force. The comb tool extension 510*a* would include a comb tool extension platform padded top surface element 528*a* to maintain consistency in shape and function with the extendable comb tool 510.

The stylist 800 or other user can insert the comb tool extension platform assembly insert 519*a* of the comb tool extension 510*a* into the comb tool extension platform assembly insert receiving cavity 518 of the extendable comb tool 510 to extend a length of the extendable comb tool 510. It is desirous that the cross sectional shape of the extendable comb tool 510 and the comb tool extension 510*a* be symmetric about a vertical section extending along an elongated central axis of the extendable comb tool 510 and the comb tool extension 510*a*. This enables the comb tool extension 510*a* to be inserted on each end of the extendable comb tool 510. Additionally, the comb tool extension 510*a* can include a comb tool extension platform assembly insert receiving cavity 518*a*, enabling assembly of a second comb tool extension 510*a* to the first comb tool extension 510*a*, providing more flexibility to the stylist 800 to obtain a desired length, while maintaining a compact storage size.

An optional end cap 560 can be assembled to each end of the final assembly comprising the extendable comb tool 510 and the any number of comb tool extensions 510*a*, wherein the end cap 560 provides an aesthetic end, and preferably a watertight seal. The optional end cap 560 includes an end cap assembly insert 569 extending axially from an assembly surface of an end cap wall 562. The end cap assembly insert 569 is of a size and shape enabling insertion and assembly to an exposed end of either of the extendable comb tool 510 and/or the comb tool extension 510*a*. More specifically, the end cap assembly insert 569 is of a size and shape enabling insertion into the comb tool extension platform assembly insert receiving cavity 518 of the extendable comb tool 510 and/or the comb tool extension platform assembly insert receiving cavity 518*a* of the comb tool extension 510*a*. A seal or other gasket material can be inserted between mating faces of the end cap wall 562 and the extendable comb tool 510 or the comb tool extension 510*a*.

It is understood that each of the at least one comb tool extension platform assembly insert receiving cavity 518 can be of any suitable cross sectional shape and depth. In a condition where the cross sectional shape were circular, it would be advantages to include at least two comb tool extension platform assembly insert receiving cavities 518 to avoid an unwanted rotational motion between the extendable comb tool 510 and the comb tool extension 510*a*, such as the extendable comb tool 610 and the comb tool extension 610*a* introduced in FIG. 9.

Like elements of the extendable hair extension comb tool 510 and the extendable hair extension comb tool 610 are numbered the same, whereas the elements of the extendable hair extension bar comb tool 610 are preceded by the numeral "6". A hair extension comb tool extension 610*a* and the exemplary comb tool 610 comprise a number of like elements. Like elements of the extendable hair extension bar comb tool 610 and the hair extension comb tool extension 610*a* are numbered the same, whereas the elements of the hair extension comb tool extension 610*a* are succeeded by the letter "a".

The exemplary extendable hair extension comb tool 510 and the exemplary extendable hair extension comb tool 610 utilize a comb tool extension platform assembly insert 619*a* having a circular cross sectional shape and the respective comb tool extension platform assembly insert receiving cavity 618 having a like circular cross sectional shape. To avoid any rotation due to either of the comb tool extension platform assembly insert 619*a* and the respective comb tool extension platform assembly insert receiving cavity 618 having a circular cross sectional shape, a plurality of comb tool extension platform assembly inserts 619*a* and the respective comb tool extension platform assembly insert receiving cavities 618 are employed in the extendable comb tool 610 and the comb tool extension 610*a*. The comb tool extension platform assembly inserts 619*a* can be fabricated of a dowel. The dowel can be fabricated of wood, plastic, metal, a composite material, and the like. The utilization of a circular cross section shaped comb tool extension platform assembly insert 619*a* and respective comb tool extension platform assembly insert receiving cavities 618 simplifies the manufacturing process when fabricating an extendable comb tool platform 611 of certain materials, such as a solid material, wood, metal, plastic, and the like, where the respective comb tool extension platform assembly insert receiving cavities 618 can be drilled into each respective end thereof. In the comb tool extension 610*a*, the bore can be drilled through the comb tool extension platform 611*a*, where circular cross section shaped comb tool extension platform assembly insert 619*a* can be inserted into one of the ends of the through hole and mechanically secured (such as by a screw, a rivet, etc.) or bonded in position (using an adhesive, an epoxy, a glue, or any other suitable bonding agent).

The end cap 660 can include a plurality of end cap assembly insert receiving bores 668, an end cap assembly insert 669 inserted into each respective end cap assembly insert receiving bore 668. The exterior surface can be sanded or machined smooth following assembly of the end cap assembly inserts 669 into the end cap assembly insert receiving bores 668. Alternatively, the end cap assembly inserts 669 can be inserted into end cap assembly insert receiving bores 668 that terminate internally within the end cap wall 662.

The flat working region 127 is needed to color (or re-color) or otherwise treat the extension hair near the hair extension weft 144. A "hair extension weft" 144 is generally defined as: "Machine wefted or machine weft hair extensions refer to products which have been sewn or 'wefted' to create the bundle of extensions. Loose or 'bulk' hair is fed through a triple-head sewing machine to add a reinforced stitch near the top (root) of the individual strands." See "Hair Extension Types—Indique Hair" at <https://www.indique-hair.com/hair-extensions-types.html> (captured Mar. 11, 2019); see also "WHAT ARE WEFT HAIR EXTENSIONS?Weft hair extensions are traditionally known as 'machine weft' which is one long piece of hair extensions which is sewn together." at <https://www.humanhairextensiononline-.com.au/blog/what-are-weft-hair-extensions/> (captured Mar. 11, 2019). A "weft" 144 in the fabric industry is defined "(in weaving) [as] the crosswise threads on a loom over and under the warp threads to make cloth. [As in] 'weft threads'. Oxford online dictionary at <https://en.oxforddictionaries-.com/definition/weft> (captured Mar. 11, 2019).

Stylists 900 may or may not distinguish machine-made hair extension wefts 144 with skin injection hair wefts 144. However, all these hair extension wefts 144 need to be color-matched to the client's desired hair style. Hence, the need for coloring or re-coloring (application of color or other treatment 942) close to the hair extension carrier 142, whether that carrier 142 is polyurethane or keratin or a weft woven carrier, as shown in the exemplary illustration presented in FIG. 17.

Therefore, the hair extension bar comb tool 110 provides a flat surface at work region 127 such that the stylist 900 can carefully apply color or other treatment 942 to the extension hair near and adjacent the weft 144 or extension carrier 142 using a color applicator brush 940, as shown in the exemplary illustration presented in FIG. 17. Further, if the weft 144 or carrier 142 is not pinned down to the top surface 126, the stylist 900 can pull the weft 144 or carrier 142 closer to one comb row 120, 122 compared to the other comb row 122, 120. In this manner the color application is uniformly applied over the length of the hair extension 140 by a simple "pulling left" action by the stylist 900 or a simple "pulling right" action by the stylist 900. In FIG. 4, the dots represent further hairs from weft or carrier 144.

The sloped working region 114 and, to some extent, the flat lateral side region 125, permits the stylist 900 to better and more easily apply color or treatment to the remaining length of extension hair falling from the hair extension bar comb tool 110. The obtuse angle 16*a* (FIG. 1) greatly improves the application of color or other treatments 942 (FIGS. 16, 17, and 18). Further, extension hair strands 129 falling off beyond a lower edge of the slope 114 can be easily colored or treated by the stylist 900 using one hand (illustrated as the second hand 912) behind the falling or unsupported hair strands 129 and the other hand (illustrated as the first hand 910) holding the color applicator brush 940 (FIGS. 16, 17, and 18). In this sense, the hair extension bar comb tool 110 mimics the hair falling off the client's head. In FIGS. 4 and 5, hair strands 144*a* are shown only to illustrate that the stylist 900 can flatten out the hair strands 129 falling over slope 114 to achieve nearly a one-on-one hair treatment. Of course, the slope 112 acts in the same manner as the slope 114.

It should be noted that the hair extension weft 144 need not be passed through both comb rows 120, 122. Instead, all the strands of extension hairs from the hair weft 144 can be placed through a single comb row 120 for color or other treatment 942, as illustrated in FIGS. 5 and 6.

Figure 12:
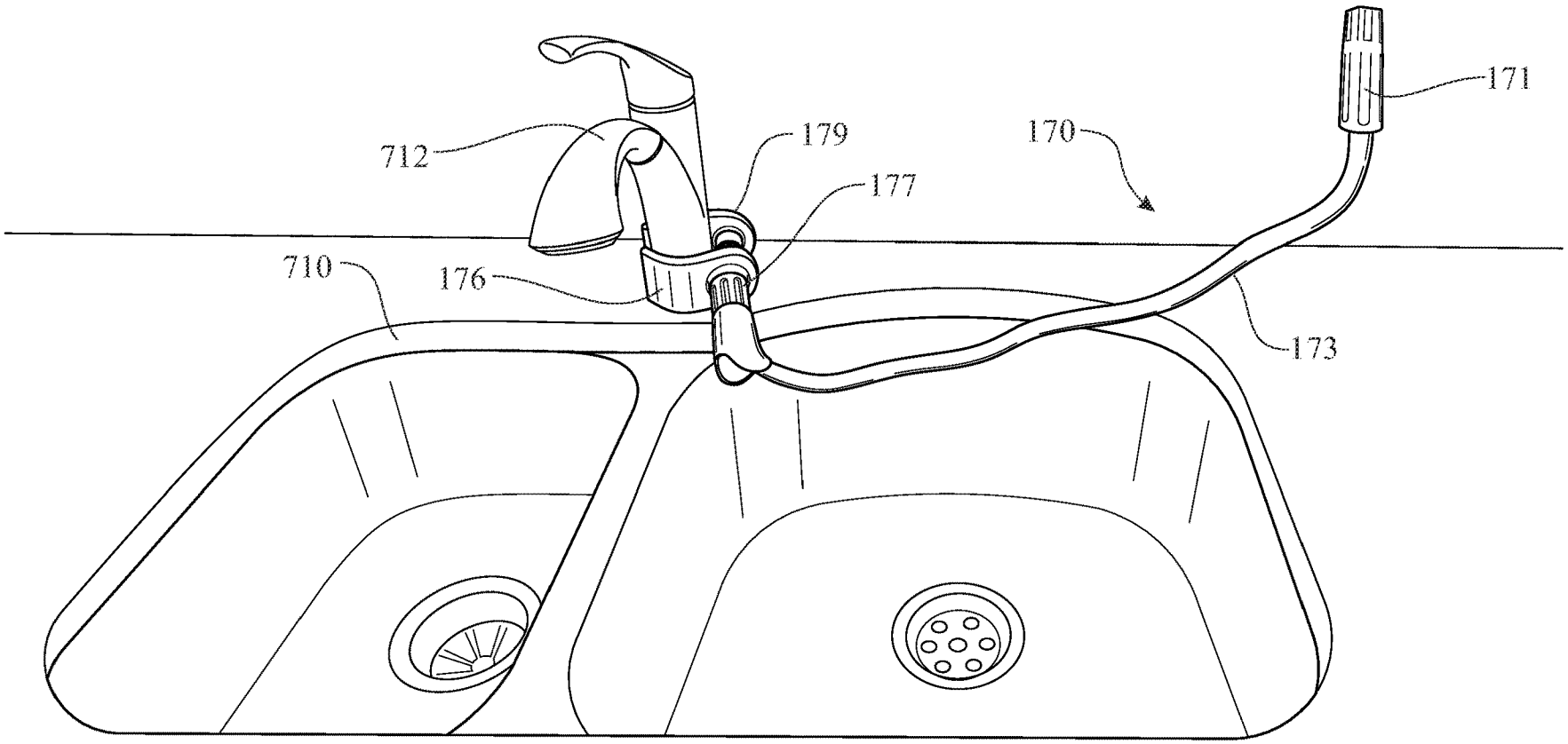
FIG. 12 presents a front, top isometric view of an optional faucet mounting bracket for supporting any of the embodiments of the exemplary hair extension bar comb tools.
Figure 13:
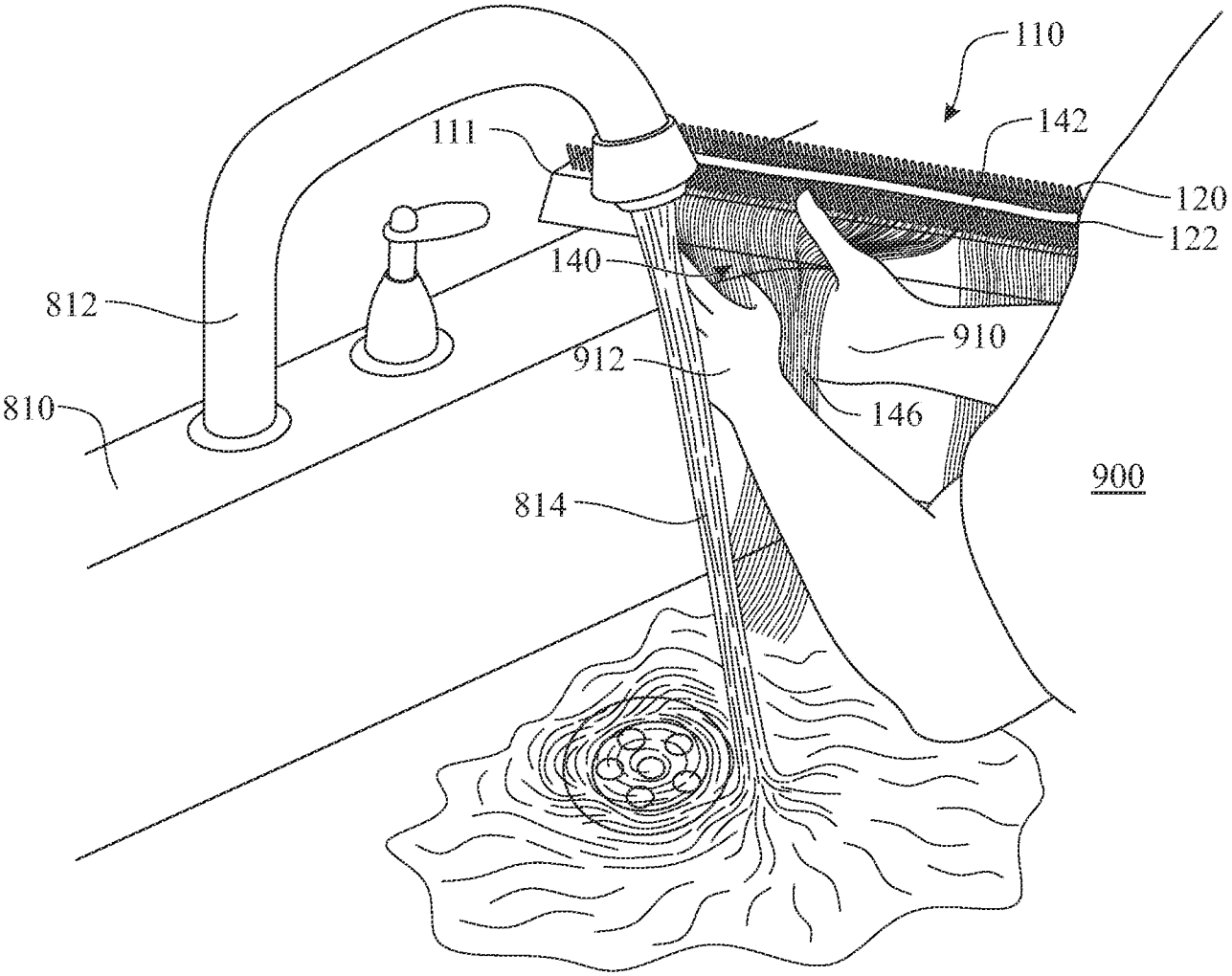
FIG. 13 presents an illustrative view of the first exemplary hair extension bar comb tool originally introduced in FIG. 1, wherein the drawing illustrates an exemplary use of the first exemplary hair extension bar comb tool enabling a hair stylist to wash the hair extensions, while the hair extensions remain supported by the first exemplary hair extension bar comb tool.
Figure 14:
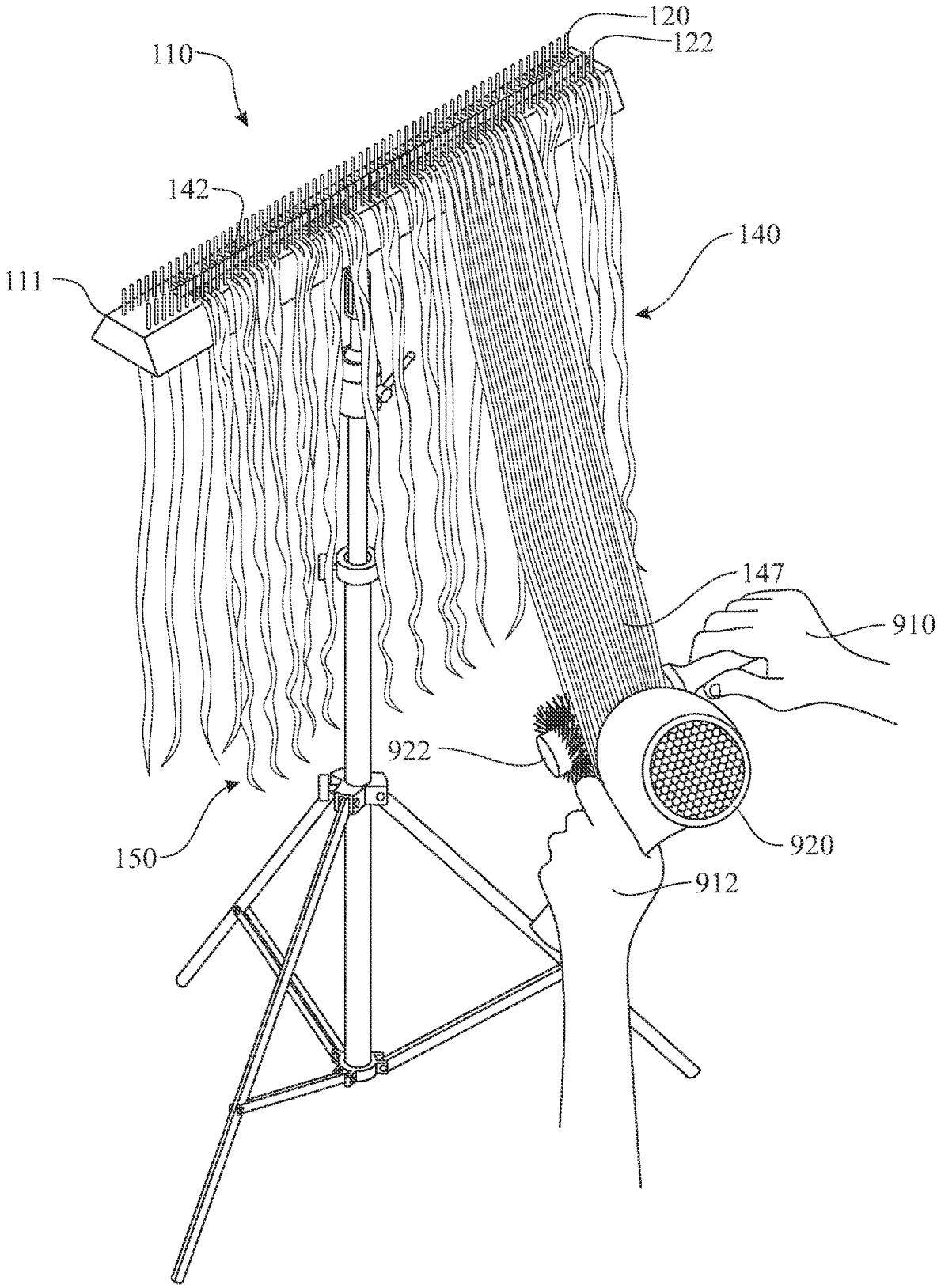
FIG. 14 presents an illustrative view of the first exemplary hair extension bar comb tool originally introduced in FIG. 1, wherein the drawing illustrates another exemplary use of the first exemplary hair extension bar comb tool enabling a hair stylist to blow dry the hair extensions, while the hair extensions remain supported by the first exemplary hair extension bar comb tool.

In addition to color treatments 942, the hair extension bar comb tool 110 is used to wash the strands of hair 144*a* of the mounted hair extension 140 in a sink or tub 710, as illustrated in FIG. 13. The stylist 900 de-couples the hair extension bar comb tool 110 from the stand 150, 160 (see stand 150 in FIG. 10, stand 160 in FIG. 11, or stand 170 in FIG. 12) and places the hair extension bar comb tool 110 over a corner of the sink or tub 710. The strands of hair 144*a* of the hair extension 140 then fall into the sink 710 and the stylist 900 washes the strands of hair 144*a* of the hair extension 140 in the sink 710 using water 714 flowing from a faucet 712.

To dry the strands of hair 144*a* of the hair extension 140, the stylist 900 may re-mount the hair extension bar comb tool 110 onto the stand 150, 160 (or clamp the stand stem 163 on a table or shelf 720) and blow dry the hair extension 140, as illustrated in FIG. 14. One hand 910, 912 of the stylist 900 holds a hair blower 920, drying hair 147, while the other hand 912, 910, of the stylist 900 holds open the strands of hair 144*a* of the hair extension 140 or uses a hair brush 922, drying hair 147. Further the stylist 900 can comb out the strands of hair 144*a* of the hair extension 140 mounted on the hair extension bar comb tool 110 without difficulty, such as by using a comb or the hair brush 922.

Figure 15:
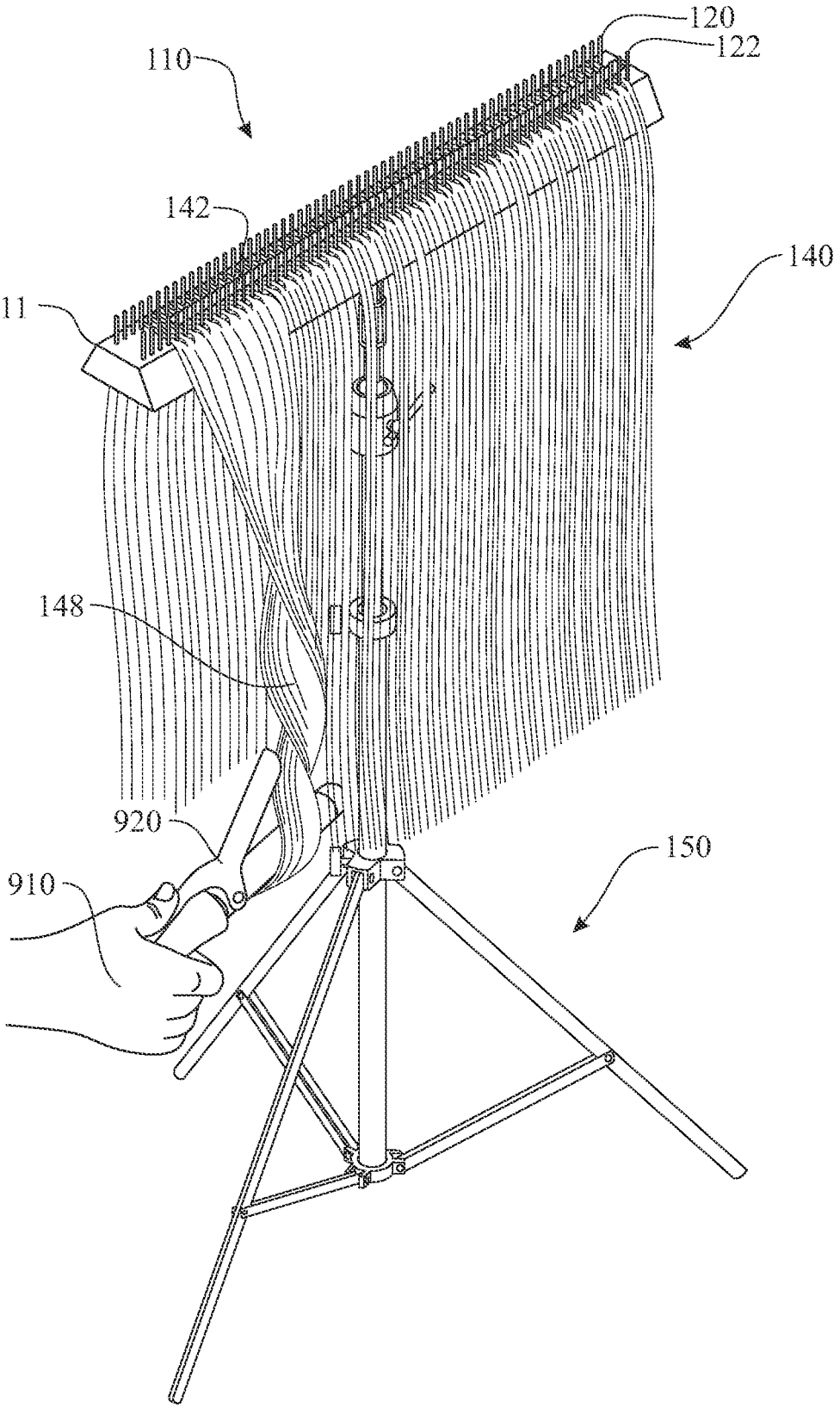
FIG. 15 presents an illustrative view of the first exemplary hair extension bar comb tool originally introduced in FIG. 1, wherein the drawing illustrates yet another exemplary use of the first exemplary hair extension bar comb tool enabling a hair stylist to curl the hair extensions, while the hair extensions remain supported by the first exemplary hair extension bar comb tool.

Similarly, the strands of hair 144*a* of the hair extension 140 can be styled, such as by using a curling iron 930, as illustrated in FIG. 15, creating styled hair 148. The hair extensions 140 are supported by the comb tool 110 mounted to the stand 150, 160, 170 (such as the stand 150, 160, 170 illustrated in FIG. 10, FIG. 11, or FIG. 12, respectively), freeing up both hands 910, 912 of the hair stylist 900 to form curls in the strands of hair 144*a* of the hair extensions 140 using the curling iron 930.

Some hair colorization uses portions of the strands of hair 144*a* of the hair extension 140 placed atop wax paper 944, as illustrated in FIG. 16. With the hair extension bar comb tool 110, the wax paper 944 is secured to or placed on either or both slopes 112, 114, a small segment of strands of hair 144*a* is drawn over the wax paper 944 and the stylist 900 colors (adding color or other treatment 942) the segmented hair thereon, commonly accomplished by using a color applicator brush 940. Multiple sheets of wax paper 944 are secured to the sloped surface 112, 114 or sloped surfaces 112, 114 which the stylist 900 will be placing over or already having the hair extensions 140 laying over. Using multiple sheets of wax paper 944 secured to the sloped surfaces 112, 114 enables the stylist 900 to separate a portion of the hair strands 144*a* from the entire set of hair strands 144*a* of the hair extensions 140 and apply color or other treatment 942 to that section without interference from other sections of the hair extension 140.

In certain applications, the customer may desire having multiple colors, highlights, etc. (provided by applying color or other treatment 942) applied to the hair extensions 140, thus coloring hair 149. The hair extension bar comb 110 eases the process of applying multiple colors, highlights, etc. (provided by applying color or other treatment 942) to the hair extensions 140, as illustrated in FIG. 18.

FIG. 10 diagrammatically illustrates one stand mount 150 for hair extension bar comb tool 110. Other mount systems, such as the table mounting stand 160 (FIG. 11) or the pipe clamp based stand 170 (FIG. 12) may be used. The bottom or lower surface 124 of the hair extension bar comb tool 110 can include a mounting coupler 139 that mates with a complementary top stem coupler unit 151. A height adjustment control 152 is a rotation-type grip lock which can be rotated to permit the stylist 900 to raise or lower the hair extension bar comb tool 110. Stem segments slide within each other. A lower stem 155 is movably mounted beneath a stem segment 153 with a second rotation-type height adjustment control 154. Tripod legs 156 illustrate one of the many stable floor stands 150 that may be used with the hair extension bar comb 110.

Figure 11:
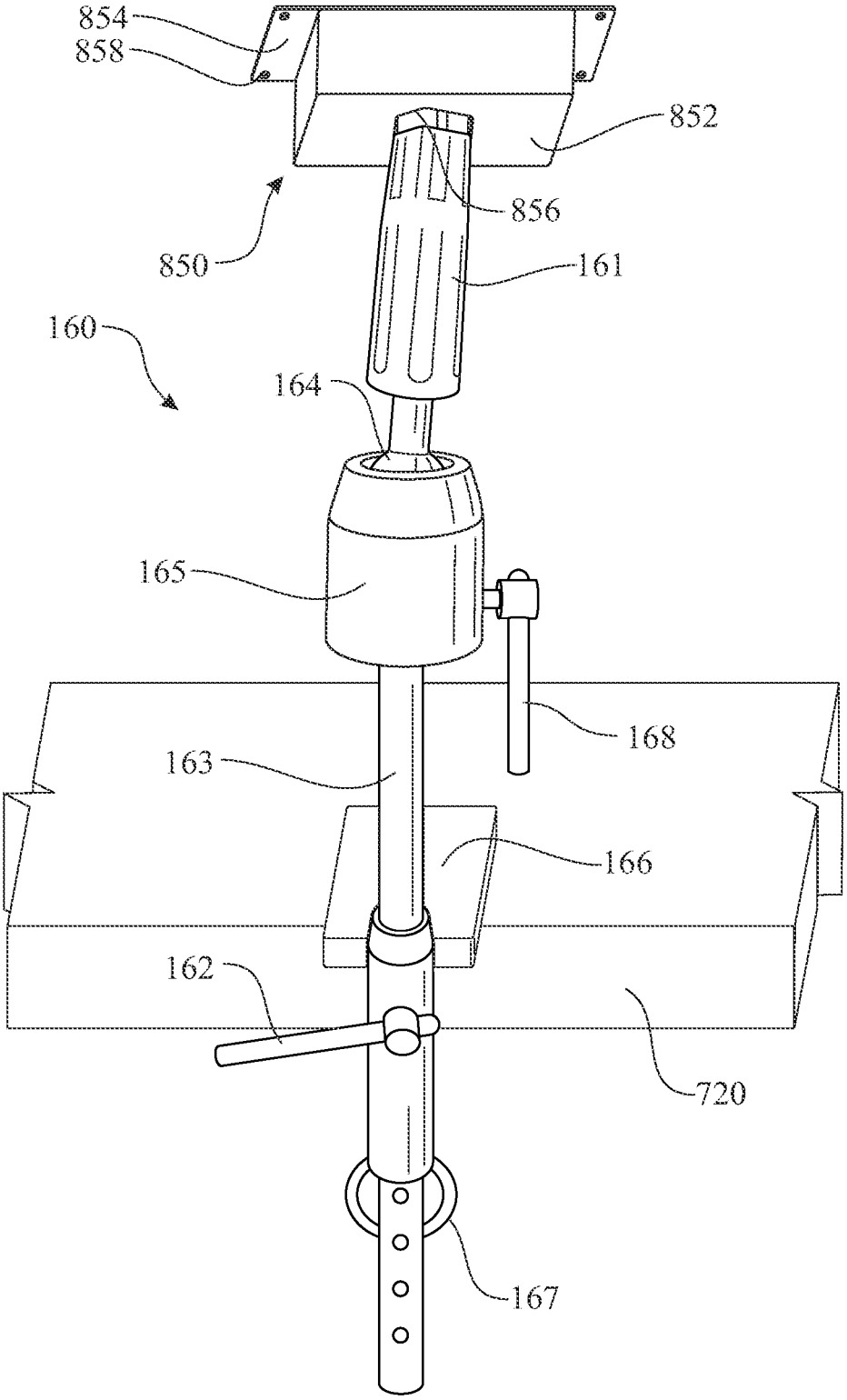
FIG. 11 presents a front elevation view of an optional desk mounting bracket for supporting any of the embodiments of the exemplary hair extension bar comb tools.

As an alternative to the tripod of the floor or table stand 150 may include a clamp based stand 160, which permits the stylist 900 to mount the hair extension bar comb tool 110 to a table or shelf 720, as illustrated in FIG. 11. See, for example, clamps in the U.S. Patent 286,662; and U.S. Pat. No. 6,585,207. An exemplary table mount assembly 160 includes a complementary top stem coupler unit 161 for securing the clamp to the bar coupler 139, such as via a mount adapter 850. The exemplary mount adapter 850 includes a mount adaptor body 852 having a mount adaptor receptacle 856 formed therein and a mount adapter assembly flange 854 located along an assembly portion of the mount adaptor body 852. A series of mount adapter assembly flange apertures 858 are provided through the mount adapter assembly flange 854. The series of mount adapter assembly flange apertures 858 are preferably arranged in a standardized pattern enabling the user to exchange the mount adapter 850 with any other existing mounting system assembled to a lower surface 124 of the hair extension bar/platform 111. The mount adapter 850 is preferably assembled to the hair extension bar/platform 111 using a number of threaded members, such as screws, bolts, or any other suitable mechanical assembly component. The mount adaptor receptacle 856 is of a size and shape to receive and retain the complementary top stem coupler unit 161. One or more exemplary mount adapters 850 can be offered, wherein each exemplary mount adapter 850 is designed to receive a specifically shaped complementary top stem coupler unit 161. A table mounted support assembly for the hair extension bar comb tool 110 includes a complementary top stem coupler unit 161 pivotally supported by a ball joint 164. The table mounted support assembly is secured to an edge of a table top, desktop, countertop (collectively represented by 720), and the like by a clamping system. The clamping system can include an upper clamp member 166 and a lower clamp member (not shown). The upper clamp member 166 and the lower clamp member are drawn together by a clamp pressure applicator 167. The ball joint 164 pivots within a ball joint receptacle 165. Once properly positioned, the ball joint 164 is retained in position within the ball joint receptacle 165 by a clamping force provided by a ball joint compression applicator 168. The complementary top stem coupler unit 161 can be adjusted to different heights by a sliding the stand stem 163 to a desired height and locking the stand stem 163 in position by tightening a height adjustment control 162.

In yet another alternative to the tripod of the floor or table stand 150 may include a pipe clamp based stand 170, which permits the stylist 900 to mount the hair extension bar comb tool 110 to a faucet 712 of a sink 710, as illustrated in FIG. 12. The exemplary pipe clamp based stand 170 includes a flexible stand stem 173. A complementary top stem coupler unit 171 is carried at a free, distal end of the flexible stand stem 173. The flexible stand stem 173 enables the stylist 900 to reposition the complementary top stem coupler unit 171 to orient the hair extension bar comb tool 110 at any suitable and desired angle. The exemplary pipe clamp based stand 170 can be adapted to include a ball joint subassembly comprising the ball joint 164, the ball joint receptacle 165, and the ball joint compression applicator 168, as previously introduced in FIG. 11. The ball joint subassembly provides additional flexibility for positioning of the hair extension bar comb tool 110. The exemplary pipe clamp based stand 170 is supported by a clamping system comprising a fixed clamp member 179, an adjustable clamp member 176, and a clamp pressure applicator 177. In the exemplary embodiment, the fixed clamp member 179 is located at a distal end of the flexible stand stem 173; the adjustable clamp member 176 is slideably assembled onto the flexible stand stem 173 at a location proximate the fixed clamp member 179; and the clamp pressure applicator 177 is threadably assembled to the flexible stand stem 173 at a location proximate the adjustable clamp member 176. The clamp pressure applicator 177 applies a force to the adjustable clamp member 176 creating a clamping force between opposing faces of the adjustable clamp member 176 and the fixed clamp member 179. In the exemplary illustration, the opposing faces of the adjustable clamp member 176 and the fixed clamp member 179 include arched surfaces. The arched surfaces provide a more stable grip around rounded surfaces, such as a pipe, a faucet 712, or any other object located proximate a basin of the sink 710. Although the above description describes using the exemplary pipe clamp based stand 170 to support the hair extension bar comb tool 110, the exemplary pipe clamp based stand 170 can be utilized to support any of the hair extension bar comb tools 110, 210 (FIG. 2), 310 (FIG. 3), 410 (FIG. 6), 510 (FIGS. 7, 8). Any of the hair extension bar comb tools 110, 210 (FIG. 2), 310 (FIG. 3), 410 (FIG. 6), 510 (FIGS. 7, 8) would include the bar coupler 139.

Figure 19:
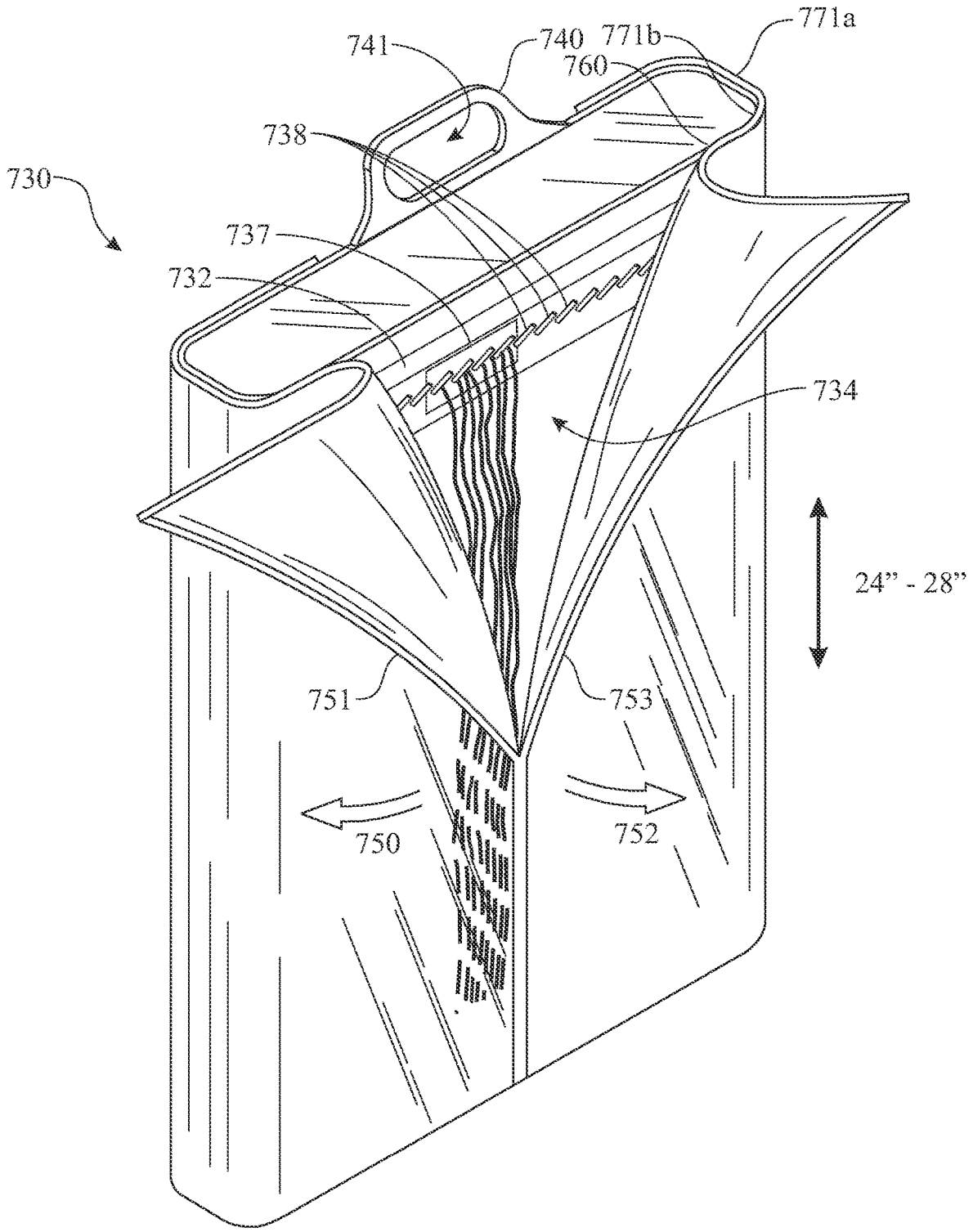
FIG. 19 presents a front view a storage bag with an interior comb hanger shown in a partially opened configuration.
Figure 20:
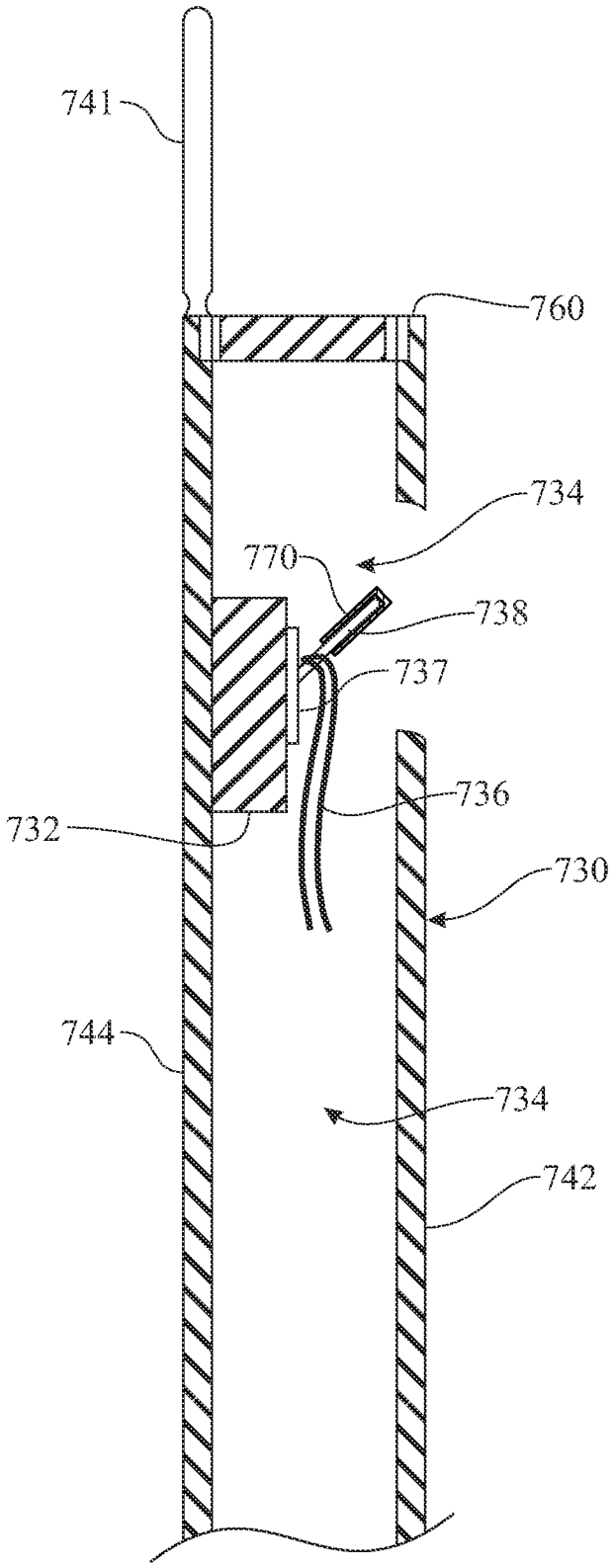
FIG. 20 presents a sectioned side view of the storage bag originally introduced in FIG. 19.

FIGS. 19 and 20 diagrammatically illustrate a storage bag for hair extensions comprising strands of hair 736 extending from a hair extension carrier 737. These figures are discussed concurrently herein. The storage bag 730 for the hair extension 736, 737 shows that extension hair 736 falls down into the bag 730 from an interior comb hanger 732 and into a vertical bag cavity534 (which may be 24-28 inches in depth). The storage bag 730 has a generally transparent front vertical panel, with a vertical closure system 751, 753, preferably a dense hook and loop tape, male and female cloth closure system. Alternatively, a tongue and groove vertical closure system 751, 753 may be used, similar to the ZIP-LOK (tm) closure system. A zipper closure 750, 752 may also be used.

FIGS. 19 and 20 show storage bag 730 with an interior comb hanger 732. Hair extensions 736, 737 are shown extending into the inboard or interior cavity 734. Near the top edge of bag 730, a substantially horizontal comb hanger 732 is mounted on the inside surface of bag 730. Comb hanger 732 includes a single row of comb teeth 738. The teeth are mounted at an acute angle from the operational surface of the interior bar (about 70-80 degrees). The teeth either horizontally extend from the horizontal bar 732 (normal to the vertical bag cavity) or at an acute angle with respect to the vertical bag cavity. The bag comb teeth may be at a 90 degree angle to the vertical surface of the comb hanger 732 or less than 90 degrees from the bar. The hair extension carrier 737 is mounted on these comb teeth 738. The comb teeth 738 generally extend the entire length of interior comb hanger 732.

In addition, extending above the upper closure system 760 (discussed later) is a tab or a flap 740 which includes an aperture 741 such that user can hang the storage bag 730 vertically and not adversely affect hair strands 736 extending from the hair extension carrier 737 hanging from the interior hanger bar 732 into the lower regions of cavity 734.

FIG. 20 shows a cross-sectional side view of the storage bag 730 and the interior comb hanger 732 and comb teeth 738. A closure system 760 closes the top of the storage bag 730. The hair strands 736 of the hair extension 736, 737, as shown in the drawing, hangs between the front-side bag layer 742 and the back-side bag layer 744. The closure system 760 may be a ZIPLOC (tm) type tongue and groove closure or interlocking tongue and groove system, a snap, a button or bar co-acting with slots or button holes, or a zipper or other type of closure system, such as a hook and loop cloth closure system (see VELCRO (tm) closures).

The storage bag 730 is about 24-28 inches long and enables the user to encase the hanging hair extensions 736, 737 in a depending generally flat condition within the storage bag 730.

The interior comb bar 732 carries a single set of comb teeth 738, where the teeth 738 are mounted at an acute angle with respect to the outboard facing surface of the interior hanger bar 732. The outboard facing surface of the interior bar faces inboard into cavity 734 of the hair extension bag 730. The comb teeth 738 extend away from the bar's outboard facing surface.

The storage bag 730 can be utilized by stylists 900 and consumers. The stylist 900 can keep the left over hair extension(s) 736, 737 organized and tangle free and customized by color or client and not just thrown in a bag or bin. The consumer can store their hair extensions 736, 737 when un-used and choose to hang in closet for future use. This is ideal for clip-in hair extensions 736, 737 or the special occasion extension wearer. In today's market the hair strands 736 have become better quality and lasts longer from application to application. This increases the need to store the hair extensions 736, 737 instead of throwing away the hair extensions 736, 737. The hair extensions 736, 737 can be positioned over the series of comb teeth 738, as illustrated in FIG. 20. A hair retention comb cover 770 can be placed over the series of comb teeth 738, wherein the hair retention comb cover 770 retains the hair extensions 736, 737 in position on the series of comb teeth 738. The hair retention comb cover 770 can include a first sidewall, a second sidewall, an elongated wall spanning between distal edges of each of the first sidewall and the second sidewall and a pair of end walls, each end wall joined to a mating edge of the first sidewall, the second sidewall, the elongated wall. One or more interim ribs can be integral with the hair retention comb cover 770, wherein each interim rib would be located between adjacent comb teeth 738. Hence the consumer saves money and gives stylists 900 the organization he or she needs when storing left over hair extensions 736, 737 for future use.

The storage bags 730 will be sold as a stylist 900 pack which would consist of levels 1-12 and can be purchased separately. For example, the bags may include 12 to-be-labeled bags with custom tabs for levels 2-12 on a large lockable ring-and-hook to hang the bags that organizes and stores unused extension hair 736, 737 for a future client. The labels can bear the name of the client. The hair designer will have the option to purchase more storage bags 730 if needed. The storage bags 730 can be sold separately for consumer to store clip ins etc. for future use. All attachments and parts of the system will consist of the comb like teeth 738 for convenience and organization.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

Reference Character Descriptions

| Ref. No. | Description |
|---|---|
| 110 | comb tool |
| 111 | hair extension bar/platform |

-continued

Reference Character Descriptions

| Ref. No. | Description |
|---|---|
| 112 | sloped side |
| 113 | end wall |
| 114 | sloped side |
| 116a | obtuse angle |
| 116b | lateral span (lower surface) |
| 116c | lateral span (top surface) |
| 120 | first set of comb teeth |
| 121 | gap between adjacent comb teeth |
| 122 | second set of comb teeth |
| 124 | lower surface |
| 125 | flat lateral side region |
| 126 | planar top surface |
| 127 | flat work center region |
| 127a | reasonably large work region |
| 129 | extension hair strands falling off beyond the a lower edge of the slope |
| 139 | bar coupler |
| 140 | hair extension |
| 142 | hair weft braid or the weft carrier |
| 144 | hair extension weft carrier hair extension weft |
| 144a | two hairs |
| 146 | washed hair |
| 147 | dried hair |
| 148 | curled or styled hair |
| 149 | colored hair |
| 150 | floor or table stand assembly |
| 151 | complementary top stem coupler unit/floor or table stand |
| 152 | height adjustment control |
| 153 | stand stem |
| 154 | second rotation-type height adjustment control |
| 155 | lower stem |
| 156 | tripod legs |
| 160 | clamp based stand |
| 161 | complementary top stem coupler unit |
| 162 | height adjustment control |
| 163 | stand stem |
| 164 | ball joint |
| 165 | ball joint receptacle |
| 166 | upper clamp member |
| 167 | clamp pressure applicator |
| 168 | ball joint compression applicator |
| 170 | pipe clamp based stand |
| 171 | complementary top stem coupler unit |
| 173 | flexible stand stem |
| 176 | adjustable clamp member |
| 177 | clamp pressure applicator |
| 179 | fixed clamp member |
| 180 | magnetized member (sidewall segment) |
| 182 | magnetized member (end wall segment) |
| 184 | pin receiving member |
| 186 | retention pin |
| 190 | hair working paddle |
| 192 | hair working paddle body |
| 194 | hair working paddle handle |
| 196 | hair working paddle supporting magnetically attracted material |
| 210 | comb tool |
| 212 | side |
| 214 | side |
| 220 | first set of comb teeth |
| 222 | second set of comb teeth |
| 224 | lower surface |
| 226 | top surface |
| 231 | slope |
| 310 | comb tool |
| 312 | sloped side |
| 314 | sloped side |
| 320 | first set of comb teeth |
| 322 | second set of comb teeth |
| 324 | lower surface |
| 326 | top surface |
| 330 | side |
| 333 | mid-line |
| 327a | circumferential distance between comb rows |
| 329a | slope |

-continued

Reference Character Descriptions

| Ref. No. | Description |
|---|---|
| 410 | comb tool |
| 411 | hair extension bar/platform |
| 412 | side surface |
| 414 | side surface |
| 420 | first set of comb teeth |
| 422 | second set of comb teeth |
| 424 | bottom or lower surface |
| 427a | circumferential distance between comb rows |
| 429a | slope |
| 430 | side surface |
| 480 | magnetized member (sidewall segment) |
| 482 | magnetized member (end wall segment) |
| 484 | pin receiving member |
| 486 | retention pin |
| 510 | extendable comb tool |
| 510a | comb tool extension |
| 511 | extendable comb tool platform |
| 511a | comb tool extension platform |
| 512 | extendable comb tool sloped side |
| 512a | comb tool extension sloped side |
| 514 | extendable comb tool sloped side |
| 514a | comb tool extension sloped side |
| 518 | extendable comb tool platform interior surface |
| 518a | comb tool extension platform interior surface |
| 519a | comb tool extension platform assembly insert |
| 520 | extendable comb tool first set of comb teeth |
| 520a | comb tool extension first set of comb teeth |
| 522 | extendable comb tool second set of comb teeth |
| 522a | comb tool extension second set of comb teeth |
| 524 | extendable comb tool lower surface |
| 524a | comb tool extension platform lower surface |
| 525 | extendable comb tool flat lateral side region |
| 525a | comb tool extension platform flat lateral side region |
| 526 | extendable comb tool planar top surface |
| 526a | comb tool extension platform planar top surface |
| 528 | extendable comb tool padded top surface element |
| 528a | comb tool extension platform padded top surface element |
| 560 | end cap |
| 562 | end cap wall |
| 569 | end cap assembly insert |
| 584 | pin receiving member |
| 584A | pin receiving member |
| 610 | extendable comb tool |
| 610a | comb tool extension |
| 611 | extendable comb tool platform |
| 611a | comb tool extension platform |
| 612 | extendable comb tool sloped side |
| 612a | comb tool extension sloped side |
| 614 | extendable comb tool sloped side |
| 614a | comb tool extension sloped side |
| 618 | extendable comb tool platform interior surface |
| 618a | comb tool extension platform interior surface |
| 619a | comb tool extension platform assembly insert |
| 620 | extendable comb tool first set of comb teeth |
| 620a | comb tool extension first set of comb teeth |
| 622 | extendable comb tool second set of comb teeth |
| 622a | comb tool extension second set of comb teeth |
| 624 | extendable comb tool lower surface |
| 624a | comb tool extension platform lower surface |
| 625 | extendable comb tool flat lateral side region |
| 625a | comb tool extension platform flat lateral side region |
| 626 | extendable comb tool planar top surface |
| 626a | comb tool extension platform planar top surface |
| 628 | extendable comb tool padded top surface element |
| 628a | comb tool extension platform padded top surface element |
| 660 | end cap |
| 662 | end cap wall |
| 668 | end cap assembly insert receiving bore |
| 669 | end cap assembly insert |
| 684 | pin receiving member |
| 684A | pin receiving member |
| 730 | storage bag |
| 732 | interior comb hanger/interior comb bar |
| 734 | inboard or interior cavity |

-continued

Reference Character Descriptions

| Ref. No. | Description |
|---|---|
| 736 | hair extension |
| 737 | hair extension carrier |
| 738 | single row of comb teeth |
| 740 | tab or flap |
| 741 | aperture |
| 742 | front-side bag layer |
| 744 | back-side bag layer |
| 750 | zipper closure |
| 751 | vertical closure system |
| 752 | zipper closure |
| 753 | vertical closure system |
| 760 | upper closure system |
| 710 | sink or tub |
| 712 | faucet |
| 714 | water |
| 720 | tabletop, desktop, countertop |
| 810 | sink or tub |
| 812 | faucet |
| 814 | water |
| 820 | table top, desktop, countertop |
| 850 | mount adapter |
| 852 | mount adaptor body |
| 854 | mount adapter assembly flange |
| 856 | mount adaptor receptacle |
| 858 | mount adapter assembly flange aperture |
| 900 | stylist |
| 910 | stylist first hand |
| 912 | stylist second hand |
| 920 | hair blower |
| 922 | hair brush |
| 930 | curling iron |
| 940 | color applicator brush |
| 942 | color or other treatment |
| 944 | wax or other backing paper |

What is claimed is:

1. A hair extension bar comb assembly comprising:

an elongated platform comprising an upper surface, a lower surface, a first side surface a second, opposite side surface, a first end wall and a second, opposite end wall;

the first side surface being bound by contiguous first edges of the upper surface, the first end wall, the second, opposite end wall, and one of the lower surface or a position below the lower surface, the second, opposite side surface being bound by contiguous second, opposite edges of the upper surface, the first end wall, the second, opposite end wall, and the one of the lower surface or a position below the lower surface:

a mount provided on the lower surface, a first comb having a first series of linearly spaced teeth extending upward from the upper surface, the first series of linearly spaced teeth being oriented substantially parallel to a length of the elongated platform;

a second comb having a second series of linearly spaced teeth extending upward from the upper surface, the second series of linearly spaced teeth being oriented substantially parallel to the length of the elongated platform; and the first series of linearly spaced teeth and the second series of linearly spaced teeth being substantially parallel and spaced apart from one another by a distance that is slightly greater than a width of a welt of a hair extension, wherein a hair extension processing surface extends downward from a location proximate a respective upper surface edge to a lower edge of the processing surface, the hair extension processing surface providing support for hair of the hair extension, wherein when the hair extension is placed upon the hair extension bar comb assembly locating a welt between the first comb and the second comb, a majority of a length of strands of hair of the hair extension are located on a side of a respective one of the first comb or the second comb opposite the side of the one of the first comb and the second comb comprising the welt and the strands of hair are at least partially supported by the hair extension processing surface, and a pin receiving member, wherein the pin receiving member is located on the upper surface between the first comb and the second comb, the pin receiving member being fabricated of a material penetrable by a hand inserted pin, wherein the pin is configured to retain the hair extension.

2. The hair extension bar comb assembly as recited in claim 1, wherein a width of the upper surface of the elongated platform is less than a maximum width of the elongated platform.

3. The hair extension bar comb assembly as recited in claim 1, wherein each tooth of the first comb and the second comb has a distal free end that has a cross sectional dimension that is smaller than a cross sectional dimension at an assembly end of each tooth of the first comb and the second comb.

4. The hair extension bar comb assembly as recited in claim 1, wherein the elongated platform has a cross section shape of one of:

(a) quadrilateral,
(b) trapezoidal,
(c) isosceles trapezoidal
(d) rectangular,
(e) substantially rectangular,
(f) pentagonal,
(g) hexagonal,
(h) octagonal,
(i) circular,
(j) elliptical,
(k) semi-circular,
(l) semi-elliptical, or
(m) hemispherical elliptical.

5. The hair extension bar comb assembly as recited in claim 1, further comprising a hair backing member, wherein the hair backing member is secured to and oriented extending in an outward and downward direction from the elongated platform, wherein the hair backing member is provided to support the hair of the hair extension during processing of the hair.

6. The hair extension bar comb assembly as recited in claim 1, further comprising at least one of:

(a) a magnetic member integral with the elongated platform, and
(b) a magnetically attracting member integral with the elongated platform.

7. The hair extension bar comb assembly as recited in claim 1, further comprising a support member, the support member engaging with the mount, wherein the support member is at least one of:

(a) a floor stand,
(b) a table stand,
(c) a countertop clamping system,
(d) a pipe clamp based stand,
(e) a height adjustment function,
(f) a flexible stem,
(g) comprising a ball joint assembly,
(h) supported by a sink,
(i) supported by a faucet, and
(j) supported by a sink faucet.

8. The hair extension bar comb assembly as recited in claim 1, the hair extension bar comb assembly further comprising an extension member having an elongated platform connection interface provided proximate a respective extension member end wall;

the elongated platform further comprising an extension member connection interface provided at the respective first end wall, wherein in a condition where the elongated platform connection interface and the extension member connection interface are assembled to one another extending a working length of the hair extension bar comb assembly.

9. The hair extension bar comb assembly as recited in claim 1, the hair extension bar comb assembly further comprising an extension member having an elongated platform connection interface provided proximate a respective extension member end wall;

the elongated platform further comprising an extension member connection interface provided at the respective first end wall;

the extension member further comprising a first extension comb and a second extension comb, wherein the first extension comb is arranged to extend the first comb and the second extension comb is arranged to extend the second comb, wherein in a condition where the elongated platform connection interface and the extension member connection interface are assembled to one another extending a working length of the hair extension bar comb assembly.

10. A hair extension bar comb assembly comprising:

an elongated platform comprising an upper surface, a lower surface, a first end and a second, opposite end;

a mount provided on the lower surface of the elongated platform, at least one comb, each of the at least one comb comprising a series of linearly spaced teeth extending upward from the upper surface, each of the at least one series of linearly spaced teeth being oriented substantially parallel to a length of the elongated platform; and a pin receiving member on a welt receiving side of the at least one series of linearly spaced teeth, wherein the pin receiving member is fabricated of a material penetrable by a hand inserted pin, wherein the pin is configured to retain hair extension, and wherein each of the at least one series of linearly spaced teeth extends upward from the upper surface, wherein the at least one series of linearly spaced teeth includes a first comb having a first series of linearly spaced teeth and a second comb having a second series of linearly spaced teeth, wherein when the hair extension is placed upon the hair extension bar comb assembly locating a welt between the first comb and the second comb, a majority of a length of strands of hair of the hair extension are located on a side of a respective one of the first comb and the second comb opposite the side of the one of the first comb and the second comb comprising the welt.

11. The hair extension bar comb assembly as recited in claim 1, wherein a width of the upper surface of the elongated platform is less than a maximum width of the elongated platform.

12. The hair extensions bar comb assembly as recited in claim 10, wherein the elongated platform has a cross section shape of one of:

(a) quadrilateral,
(b) trapezoidal,
(c) isosceles trapezoidal
(d) rectangular,
(e) (e) substantially rectangular,
(f) pentagonal,
(g) hexagonal,
(h) octagonal,
(i) circular,
(j) elliptical,
(k) semi-circular,
(l) semi-elliptical, or
(m) hemispherical elliptical.

13. The hair extension bar comb assembly as recited in claim 10, further comprising a hair backing member, wherein the hair backing member is secured to and oriented extending downward from the elongated platform.

14. The hair extension bar comb assembly as recited in claim 10, further comprising at least one of (a) a magnetic member integral with the elongated platform, and
(b) a magnetically attracting member integral with the elongated platform.

15. The hair extension bar comb assembly as recited in claim 10, further comprising a support member, the support member engaging with the mount, wherein the support member is at least one of:

(a) a floor stand,
(b) a table stand,
(c) a countertop clamping system,
(d) a pipe clamp based stand,
(e) a height adjustment function,
(f) a flexible stem,
(g) comprising a ball joint assembly,
(h) a sink assembly,
(i) a faucet, and
(j) a sink faucet.

16. A hair extension bar comb assembly comprising:

an elongated platform comprising an upper surface, a lower surface, a first end wall and a second, opposite end wall;

a mount provided on the lower surface, a first comb having a first series of linearly spaced teeth extending upward from the upper surface, the first series of linearly spaced teeth being oriented substantially parallel to a length of the elongated platform;

a second comb having a second series of linearly spaced teeth extending upward from the upper surface, the second series of linearly spaced teeth being oriented substantially parallel to the length of the elongated platform; and the first series of linearly spaced teeth and the second series of linearly spaced teeth being substantially parallel and spaced apart from one another by a distance that is slightly greater than a width of a welt of a hair extension, a pin receiving member located on the upper surface between the first comb and the second comb, wherein the pin receiving member is fabricated of a material penetrable by a hand inserted pin, wherein the pin is configured to retain hair extension.

17. The hair extension bar comb assembly as recited in claim 16, wherein each tooth of the first comb and the second comb has a distal free end that has a cross sectional dimension that is smaller than a cross sectional dimension at an assembly end of each tooth of the first comb and the second comb.

18. The hair extension bar comb assembly as recited in claim 16, further comprising a support member, the support member engaging with the mount, wherein the support member is at least one of:

(a) a floor stand,
(b) a table stand,
(c) a countertop clamping system,
(d) a pipe clamp based stand,
(e) a height adjustment function,
(f) a flexible stem, and
(g) comprising a ball joint assembly.

* * * * *